US012274908B1

(12) United States Patent
Pollard

(10) Patent No.: US 12,274,908 B1
(45) Date of Patent: Apr. 15, 2025

(54) EXERCISE ATTACHMENT ASSEMBLIES

(71) Applicant: John E. Pollard, Shreveport, LA (US)

(72) Inventor: John E. Pollard, Shreveport, LA (US)

( * ) Notice: Subject to any disclaimer, the term of this patent is extended or adjusted under 35 U.S.C. 154(b) by 289 days.

(21) Appl. No.: 17/884,168

(22) Filed: Aug. 9, 2022

(51) Int. Cl.
*A63B 21/00* (2006.01)

(52) U.S. Cl.
CPC ..... *A63B 21/156* (2013.01); *A63B 21/00047* (2013.01); *A63B 21/4035* (2015.10)

(58) Field of Classification Search
None
See application file for complete search history.

(56) References Cited

U.S. PATENT DOCUMENTS 4,101,124 A 7/1978 Mahnke
4,383,684 A 5/1983 Schliep
4,598,907 A * 7/1986 Ross ..... A63B 21/06 482/133
4,911,438 A * 3/1990 Van Straaten ..... A63B 21/068 482/130
5,354,251 A * 10/1994 Sleamaker ..... A63B 21/4047 482/142
5,620,403 A * 4/1997 Lundin ..... A63B 21/154 482/130
5,938,571 A * 8/1999 Stevens ..... A63B 21/154 482/142
5,967,955 A * 10/1999 Westfall ..... A63B 21/154 482/142
6,319,179 B1 * 11/2001 Hinds ..... A63B 21/156 482/121
6,692,412 B2 * 2/2004 Chen ..... A63B 21/0622 482/96
6,767,314 B2 7/2004 Thompson
7,125,369 B2 * 10/2006 Endelman ..... A63B 22/203 482/121
7,204,790 B2 * 4/2007 Sleamaker ..... A63B 21/4029 482/142

(Continued)

FOREIGN PATENT DOCUMENTS

WO WO-2009102187 A1 * 8/2009 ..... A63B 21/00072

*Primary Examiner* — Shila Jalalzadeh Abyaneh
(74) *Attorney, Agent, or Firm* — R. Keith Harrison

(57) ABSTRACT

Exercise attachment assemblies configured for attachment to a slant carriage exercise apparatus having a sloped apparatus frame, a slide seat on the apparatus frame, a pair of main cable pulleys on the apparatus frame and a pair of main cables attached to the slide seat and engaging the pair of main cable pulleys, respectively may include an assembly frame configured for attachment to the exercise apparatus. A cable support frame may be supported by the assembly frame. A pair of outer cable pulleys may be supported by the cable support frame. A pair of outer cables may engage the respective outer cable pulleys. The outer cables may be configured for attachment to the respective main cables of the exercise apparatus. A pair of outer handles may be attached to the respective outer cables. A pair of inner cable pulleys may be supported by the cable support frame inside the respective outer cable pulleys. A pair of inner cables may engage the respective inner cable pulleys. The inner cables may be attachable to the respective outer cables and the respective main cables of the exercise apparatus. A pair of inner handles may be attached to the respective inner cables.

19 Claims, 28 Drawing Sheets

(56) References Cited

U.S. PATENT DOCUMENTS 7,503,880 B2 * 3/2009 Campanaro ..... A63B 23/03541 482/142
7,857,736 B2 * 12/2010 Merrithew ..... A63B 23/0405 482/121
7,878,954 B2 * 2/2011 McBride ..... A63B 21/023 482/121
7,892,155 B2 * 2/2011 Pearson ..... A63B 21/4047 482/121
7,967,736 B2 * 6/2011 D'Silva ..... A63B 21/00 482/121
8,109,864 B2 * 2/2012 Tseng ..... A63B 23/03566 482/121
8,172,733 B1 * 5/2012 Batca ..... A63B 21/0628 482/99
8,696,528 B2 * 4/2014 Campanaro ..... A63B 23/12 482/142
9,314,658 B2 * 4/2016 Kaye ..... A63B 23/03508
10,035,036 B2 * 7/2018 DiMartino ..... A63B 21/4007
11,712,598 B2 * 8/2023 Yang ..... A63B 23/03558 482/94
2002/0077229 A1 * 6/2002 McBride ..... A63B 23/035 482/130
2007/0093369 A1 4/2007 Bocchicchio
2007/0111866 A1 * 5/2007 McVay ..... A63B 21/0622 482/96
2007/0270293 A1 * 11/2007 Zhuang ..... A63B 21/4029 482/121
2008/0171643 A1 * 7/2008 Baudhuin ..... A63B 22/0087 482/148
2010/0267530 A1 * 10/2010 Gerschefske ..... A63B 21/023 482/130
2012/0094815 A1 * 4/2012 Trettin ..... A63B 23/0205 482/143
2021/0038940 A1 * 2/2021 Marti ..... A63B 21/4049
2021/0361997 A1 * 11/2021 Yang ..... A63B 21/0552

* cited by examiner

EXERCISE ATTACHMENT ASSEMBLIES

FIELD

Illustrative embodiments of the disclosure generally relate to exercise apparatuses. More particularly, illustrative embodiments of the disclosure relate to exercise attachment assemblies which are suitable for attachment to a slant carriage exercise apparatus to facilitate a variety of upper body strengthening exercises using resistance imparted by the weight of the exerciser.

SUMMARY

Illustrative embodiments of the disclosure are generally directed to exercise attachment assemblies which are suitable for attachment to a slant carriage exercise apparatus to facilitate a variety of upper body strengthening exercises using resistance imparted by the weight of the exerciser. An illustrative embodiment of the exercise attachment assemblies may be configured for attachment to a slant carriage exercise apparatus having a sloped apparatus frame, a slide seat on the apparatus frame, a pair of main cable pulleys on the apparatus frame and a pair of main cables attached to the slide seat and engaging the pair of main cable pulleys, respectively. The exercise attachment assembly may include an assembly frame configured for attachment to the exercise apparatus. A cable support frame may be supported by the assembly frame. A pair of outer cable pulleys may be supported by the cable support frame. A pair of outer cables may engage the respective outer cable pulleys. The outer cables may be configured for attachment to the respective main cables of the exercise apparatus. A pair of outer handles may be attached to the respective outer cables. A pair of inner cable pulleys may be supported by the cable support frame inside the respective outer cable pulleys. A pair of inner cables may engage the respective inner cable pulleys. The inner cables may be attachable to the respective outer cables and the respective main cables of the exercise apparatus. A pair of inner handles may be attached to the respective inner cables.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
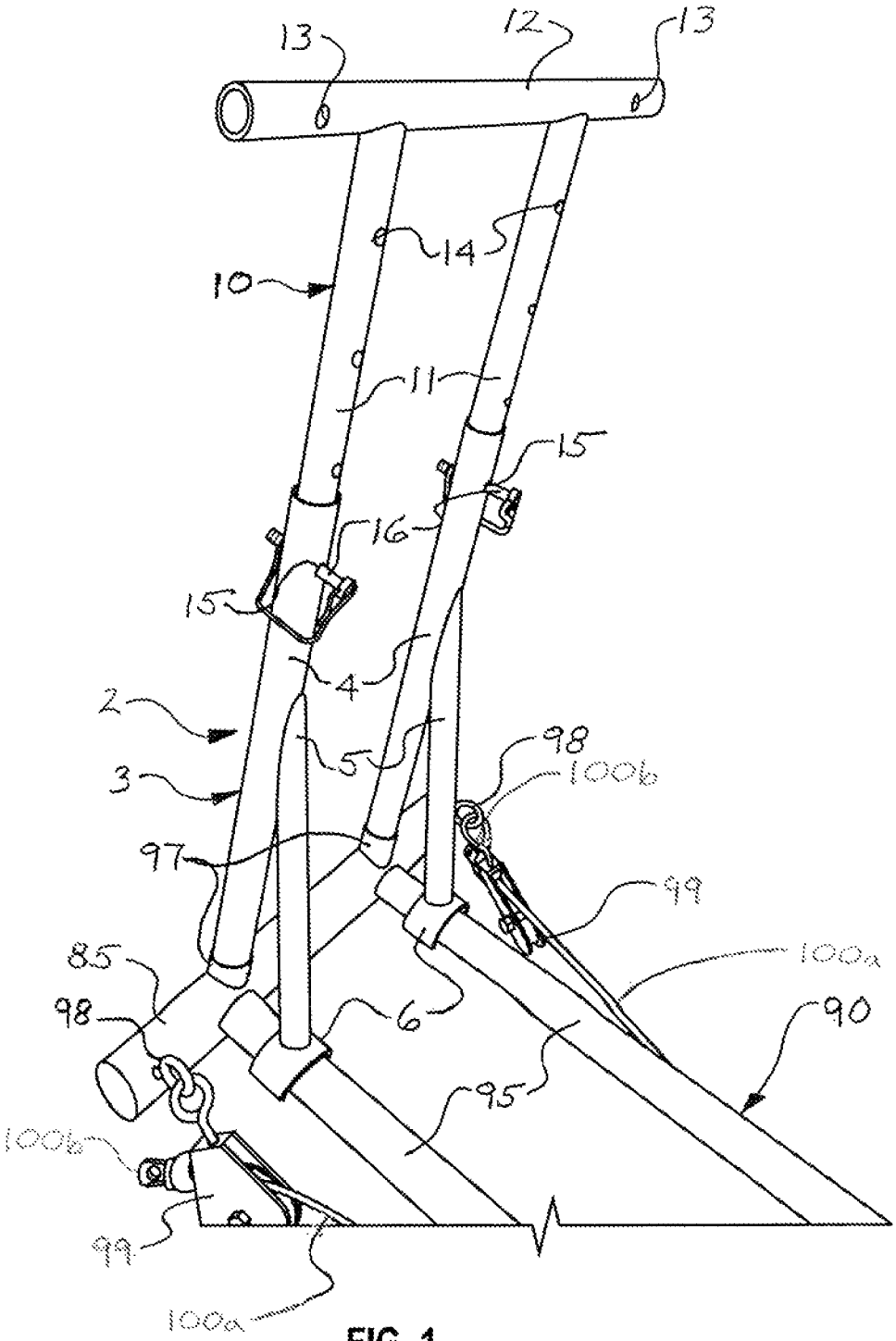
FIG. 1 is a rear perspective view of a typical assembly frame of an illustrative embodiment of the exercise attachment assemblies, attached to a standard or conventional slant carriage exercise apparatus (shown partially in section) in partial assembly of the exercise attachment assembly.
Figure 2:
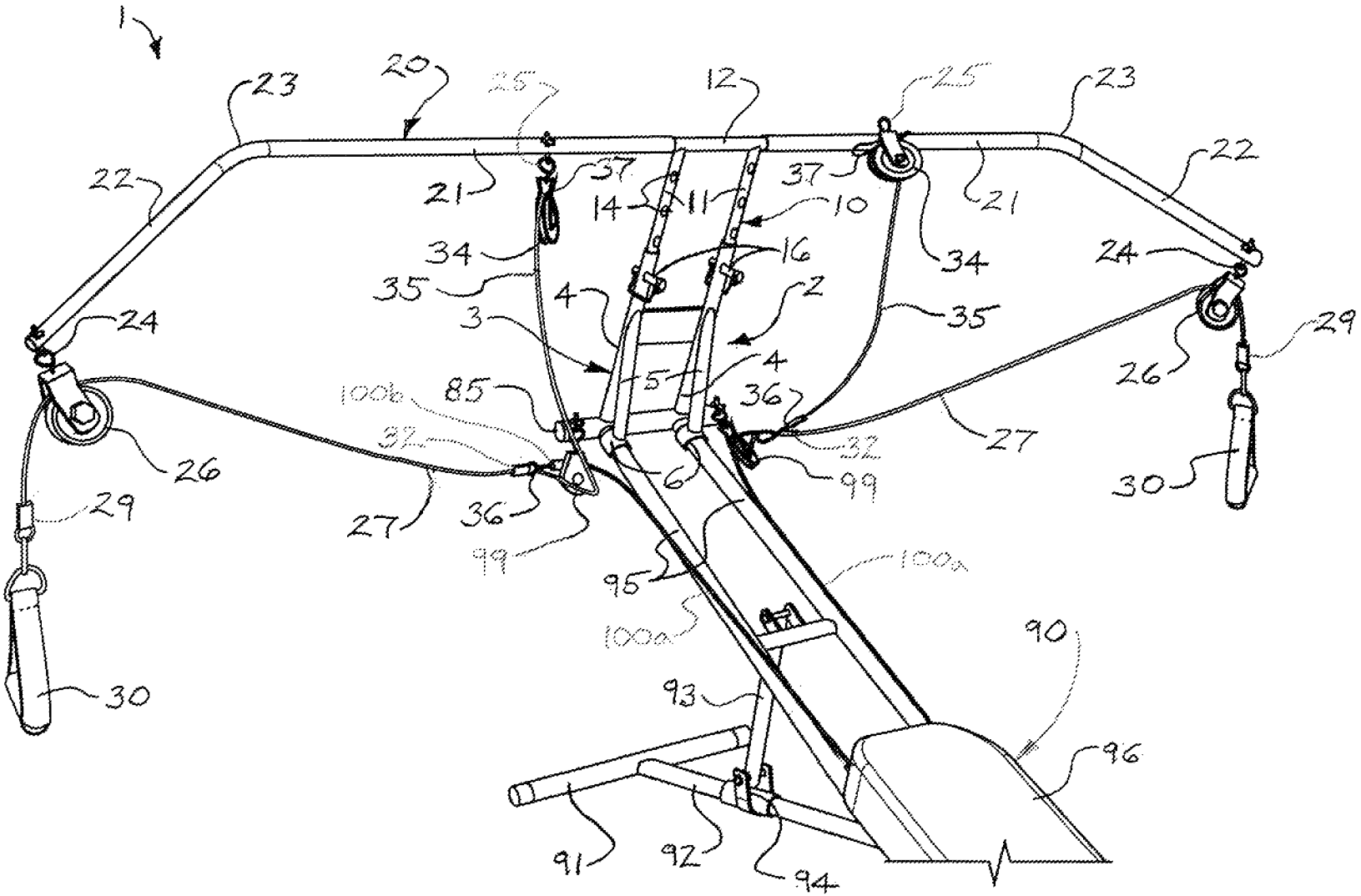
FIG. 2 is a rear perspective view of the illustrative exercise attachment assembly illustrated in FIG. 1, with the assembly frame attached to the slant carriage exercise apparatus (shown in section), a cable support frame attached to the assembly frame, a pair of outer cable pulleys and a pair of inner cable pulleys supported by the cable support frame and a pair of outer cables and a pair of inner cables supported by the respective outer cable pulleys and the inner cable pulleys and attached to the respective main cables of the slant carriage exercise apparatus.

Referring initially to FIGS. 1-4 of the drawings, an illustrative embodiment of the exercise attachment assembly of the present disclosure is generally indicated by reference numeral 1. The exercise attachment assembly 1 may be suitable for attachment to a slant carriage exercise apparatus 90 to facilitate a variety of upper body strengthening exercises on the exercise apparatus 90 using resistance imparted by the weight of an exerciser 66. The exercise apparatus 90 on which the exercise attachment assembly 1 is deployed may have a standard or conventional design, with a sloped apparatus frame 95. The apparatus frame 95 may include a pair of elongated, parallel, spaced-apart rails, as illustrated. As illustrated in FIG. 2, a bottom foot 91 may support the apparatus frame 95 on the ground, floor or other support surface (not illustrated). A slant leg 92 may extend upwardly and rearwardly from the bottom foot 91 to the apparatus frame 95. A vertical leg 93 may extend upwardly from the slant leg 92 at a pivot collar 94. The upper end of the vertical leg 93 may terminate at the apparatus frame 95 typically at a pivot bracket (not numbered). The slant leg 92 and the vertical leg 93 may support the apparatus frame 95 at a selected slope angle with respect to the support surface.

A slide carriage or seat 96 may be slidably mounted on the apparatus frame 95. The slide seat 96 may support the exerciser 66 (FIG. 3) as the exerciser 66 sits, lies, or reclines on the slide seat 96.

A front frame member 85 may terminate the forward end of the apparatus frame 95 of the exercise apparatus 90. As illustrated in FIG. 1, a pair of main cable pulleys 99 may be attached to the front frame member 85, typically via a respective pair of pulley hooks 98. A pair of main cables 100*a* may be attached to the slide seat 96. The main cables 100*a* may extend forwardly from the slide seat 96 alongside the apparatus frame 95 and engage the respective main cable pulleys 99. Each main cable 100*a* may terminate in a main cable connector 100*b* for purposes which will be hereinafter described. A pair of spaced-apart frame collars 97 may extend upwardly from the front frame member 85 between the pulley hooks 98. In the conventional exercise apparatus 90, the frame collars 97 may support structures which facilitate a variety of exercises as an exerciser 66 typically sits or reclines on the slide seat 96.

The exercise attachment assembly 1 of the present disclosure may include an assembly frame 2. The assembly frame 2 may be configured for attachment to the exercise apparatus 90, typically as will be hereinafter described. As illustrated in FIG. 2, a cable support frame 20 may be supported by the assembly frame 2. A pair of outer cable pulleys 26 may be supported by the cable support frame 20. A pair of outer cables 27 may engage the respective outer cable pulleys 26. The outer cables 27 may be configured for attachment to the respective main cables 100*a* of the exercise apparatus 90, typically as will be hereinafter described. A pair of outer handles 30 may be attached to the respective outer cables 27.

Figure 3:
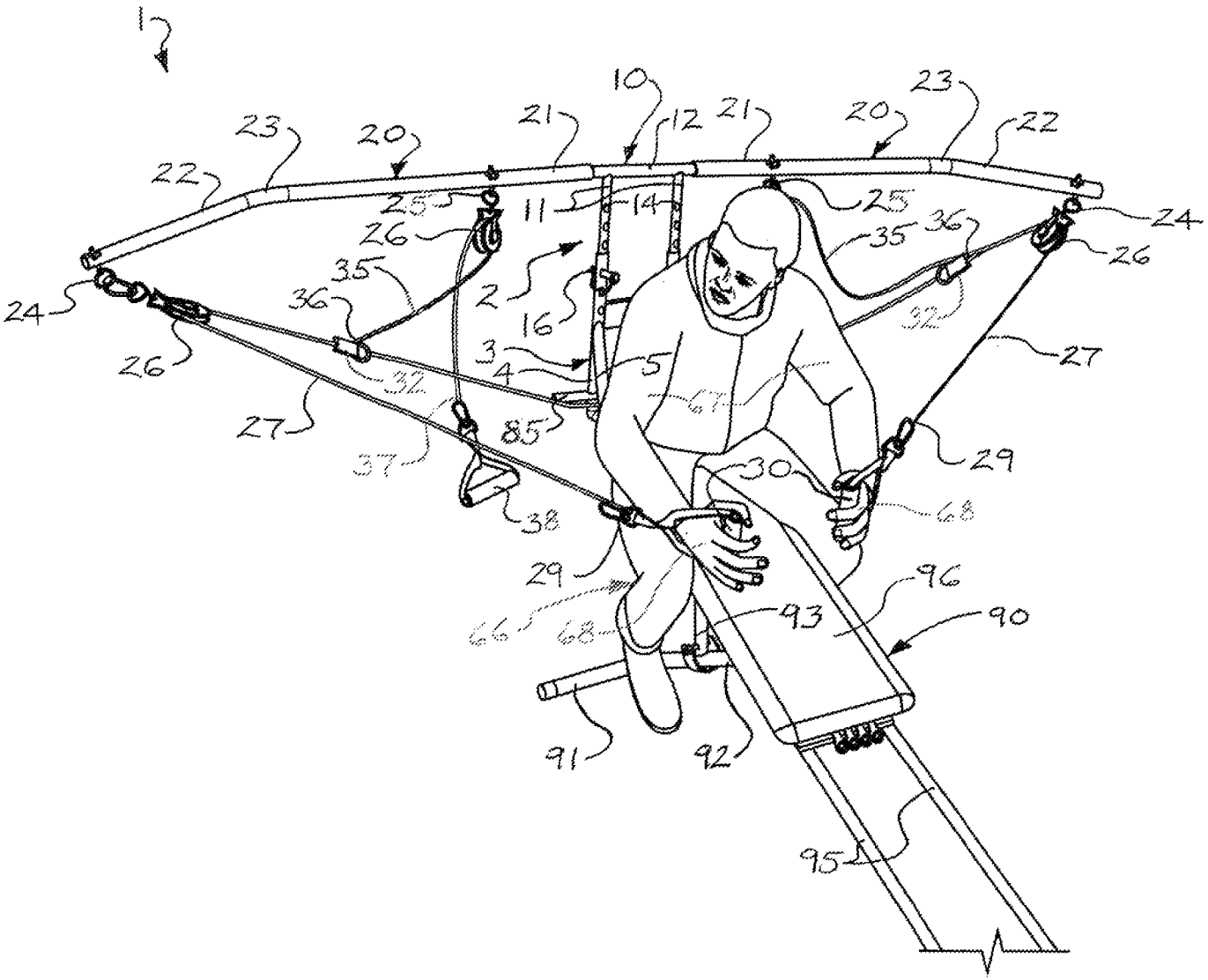
FIG. 3 is a rear perspective view of the illustrative exercise attachment assembly illustrated in FIG. 2, with a rearwardly-facing exerciser sitting on a slide seat of the slant carriage exercise apparatus while performing wide-motion arm and chest exercises using a pair of outer handles attached to the respective pair of outer cables of the assembly.
Figure 4:
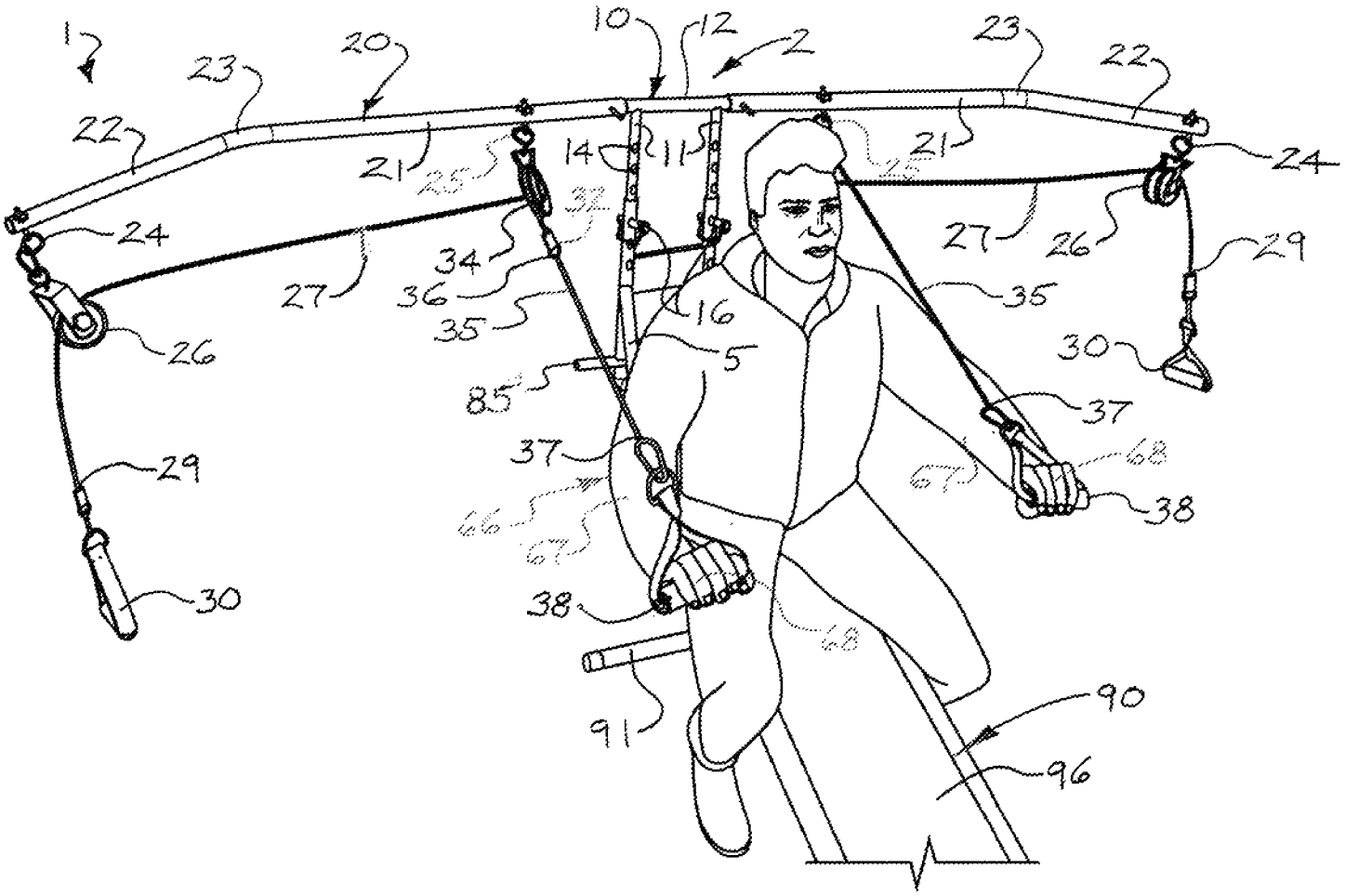
FIG. 4 is a rear perspective view of the illustrative exercise attachment assembly with the exerciser sitting on the slide seat of the slant carriage exercise apparatus while performing narrow-motion arm and chest exercises using a pair of inner handles attached to the respective pair of inner cables of the assembly.

A pair of inner cable pulleys 34 may be supported by the cable support frame 20 inside the respective outer cable pulleys 26. A pair of inner cables 35 may engage the respective inner cable pulleys 34. The inner cables 35 may be selectively attachable to the respective outer cables 27 typically as will be hereinafter described. As illustrated in FIG. 3, a pair of inner handles 38 may be attached to the respective inner cables 35. Accordingly, as illustrated in FIGS. 3 and 4, an exerciser 66 may sit, lie, or otherwise recline on the slide seat 96 of the exercise apparatus 90 and grip and pull or otherwise move the outer handles 30 and the inner handles 38 to perform a variety of upper body strengthening exercises which may not be possible using the conventional exercise apparatus 90 with its standard accessories.

As illustrated in FIG. 1, in some embodiments, the assembly frame 2 of the exercise apparatus 1 may include a base frame portion 3. A cable support frame portion 10 may be adjustably supported by the base frame portion 3. The cable support frame 20 (FIGS. 2-4) may be supported by the cable support frame portion 10 of the assembly frame 2, typically as will be hereinafter described.

As further illustrated in FIG. 2, the base frame portion 3 of the assembly frame 2 may include a pair of elongated, parallel, spaced-apart base frame arms 4. The base frame arms 4 may be configured for attachment to the front frame member 85 of the exercise apparatus 90. In some embodiments, the base frame arms 4 may be configured to engage the respective frame collars 97 on the front frame member 85. For example and without limitation, in some embodiments, the base frame arms 4 may be sized and configured for insertion into the respective frame collars 97, as illustrated in FIG. 1.

A pair of angled base frame legs 5 may extend downwardly and rearwardly from the respective base frame arms 4. A pair of curved or concave base frame feet 6 may terminate the respective base frame legs 5. The base frame feet 6 may be sized and configured to engage the respective rails on the apparatus frame 95 of the exercise apparatus 90. Accordingly, the base frame legs 5 may stabilize the base frame portion 3 and the cable support frame portion 10 of the assembly frame 2 on the apparatus frame 95 in a rearwardly-tilted configuration with respect to a vertical plane.

The cable support frame portion 10 of the assembly frame 2 may include a pair of elongated, parallel, spaced-apart support frame arms 11. In some embodiments, the support frame arms 11 may be telescopically extendable from the respective base frame arms 4 of the base frame portion 3. Accordingly, support frame pin openings 14 may be provided in each support frame arm 11. A frame height adjusting pin 16 may be extendable through a base frame pin opening 15 (FIG. 1) in each assembly frame arm 4 of the cable support frame portion 10 and through a selected one of the pin openings 14 in the corresponding support frame arm 11 of the cable support frame portion 10 to secure the able support frame portion 10 at the selected extended height from the base frame portion 3. In this manner, the height of the outer cable pulleys 26 and the inner cable pulleys 34 may be selectively adjusted to vary the reach and trajectory of the pulling, pushing or other motion which the exerciser 66 exerts against the outer cables 27 and the inner cables 35 via the respective outer handles 30 and inner handles 38.

At least one cable support frame mount member 12 may be supported by the support frame arms 11 of the cable support frame portion 10. The cable support frame mount member 12 may extend horizontally between the upper ends of the support frame arms 11 of the cable support frame portion 10. The cable support frame 20 may be supported by the cable support frame mount member 12 typically as will be hereinafter described.

As illustrated in FIG. 1, in some embodiments, the opposite ends of the cable support frame mount member 12 may protrude beyond the respective support frame arms 11 of the cable support frame portion 10 of the assembly frame 2. Accordingly, the cable support frame 20 may be supported by the protruding ends of the cable support frame mount member 12, typically as will be hereinafter described.

The cable support frame 20 may have any design which is suitable for supporting the outer cable pulleys 26 and the inner cable pulleys 34 in the spaced-apart configuration to facilitate the various exercises using the outer cables 27 and the inner cables 35. Accordingly, in some embodiments, the cable support frame 20 may include a pair of elongated main arm segments 21. The main arm segments 21 may be supported by the cable support frame mount member 12 of the cable support frame portion 10 of the assembly frame 2 according to the knowledge of those skilled in the art. For example and without limitation, in some embodiments, the main arm segments 21 may receive or may be inserted into the respective protruding ends of the cable support frame mount member 12. At least the inner cable pulleys 34 may be supported by the respective main arm segments 21 of the cable support frame 20, as illustrated.

In some embodiments, the main arm segments 21 may constitute the entire length of the cable support frame 20. Accordingly, both the outer cable pulleys 26 and the inner cable pulleys 34 may be supported by the main arm segments 21. In other embodiments, a pair of arm bends 23 may extend from the respective main arm segments 21. A pair of terminal arm segments 22 may extend from the respective arm bends 23 such that the terminal arm segments 22 are angled downwardly with respect to the respective main arm segments 21. The outer cable pulleys 26 may be supported by the respective terminal arm segments 22, typically via a respective pair of outer pulley attachment books 24, whereas the inner cable pulleys 34 may be supported by the respective main arm segments 21, typically via a respective pair of inner pulley attachment hooks 25, as illustrated.

In some embodiments, the cable support frame 20 may be selectively length adjustable according to the knowledge of those skilled in the art. Accordingly, as illustrated in FIG. 1, pin openings 13 may be provided in the respective protruding ends of the cable support frame mount member 12 of the cable support frame portion 10 of the assembly frame 2. A frame pin (not illustrated) may be inserted through each pin opening 13 and through a corresponding one of multiple, spaced-apart pin openings (not illustrated) provided in each corresponding main arm segment 21 of the cable support frame 20 to secure the main arm segment 21 at the selected length with respect to the cable support frame mount member 12. In this manner, the distances between the outer cable pulleys 26 and the inner cable pulleys 34 may be selectively adjusted to vary the reach, breadth or width of the pulling, pushing or other motion which the exerciser 66 exerts against the outer cables 27 and the inner cables 35 via the respective outer handles 30 and inner handles 38.

As illustrated in FIGS. 2 and 3, in some applications of the exercise attachment assembly 1, the outer cables 27 may be attached to the respective main cables 100*a* of the exercise apparatus 90, typically via a respective pair of main cable connectors 100*b* (FIG. 1), to enable the exerciser 66 to perform wide-motion arm and chest exercises. The outer handles 30 may be attached to the outer cables 27 typically via respective outer handle connectors 29. Each inner cable 35 may have a cable attachment end 36 which is attached to the corresponding outer cable 27, typically adjacent to the main cable connector 100*b*, via an inner cable connector 32. The inner handles 38 may be attached to the inner cables 35 typically via respective inner handle connectors 37.

As illustrated in FIG. 3, the exerciser 66 may initially grasp the outer handles 30 and then sit in the reverse direction on the slide seat 96 of the exercise apparatus 90, facing down the slope of the apparatus frame 95 away from the assembly frame 2. With the arms 67 initially stretched outwardly, the exerciser 66 may then pull the outer handles 30 inwardly toward the midline of the exerciser's torso. Simultaneously, the outer cables 27 may traverse the respective outer cable pulleys 26 as the outer cables 27 pull the slide seat 90 up the inclined apparatus frame 95 toward the assembly frame 2, via the respective main cables 100*a*, against the resistance imparted by the body weight of the exerciser 66. After the exerciser 66 has pulled the outer handles 30 adjacent to each other in front of the midline of the exerciser's torso, the exerciser 66 may then reverse the motion as the exerciser 66 spreads and stretches the arms 67 outwardly on the respective sides of the exerciser 66 against the resistance imparted by the exerciser's weight. Accordingly, the weight of the exerciser 66 may simultaneously cause the slide seat 96 to slide downwardly on the apparatus frame 95 away from the assembly frame 2. This motion may be repeated for a selected number of repetitions and sets to exercise and strengthen the chest, shoulder, and arm muscles of the exerciser 66.

As illustrated in FIG. 4, in some applications, the exerciser 66 may perform narrow-motion arm and chest exercises which focus on strengthening the triceps and chest of the exerciser 66. Accordingly, the exerciser 66 may initially grasp the inner handles 38 and then sit in the reverse direction on the slide seat 96 of the exercise apparatus 90. With the arms 67 initially pulled rearwardly with the exerciser's hands 68 typically adjacent to the exerciser's torso, the exerciser 66 may then push the inner handles 38 forwardly away from the respective sides of the exerciser's torso. Simultaneously, the inner cables 27 may traverse the respective inner cable pulleys 34 as the inner cables 27 pull against the outer cables 27 at the respective inner cable connectors 32. The outer cables 27 may, in turn, pull the slide seat 90 up the inclined apparatus frame 95 toward the assembly frame 2, via the respective main cables 100*a*, against the resistance imparted by the body weight of the exerciser 66. After the exerciser 66 has pushed the inner handles 38 adjacent to each other in front of the midline of the exerciser's torso, the exerciser 66 may then reverse the motion as the exerciser 66 reverses the position of the arms 67 back to the respective sides of the exerciser 66 against the resistance imparted by the exerciser's weight. Accordingly, the weight of the exerciser 66 may simultaneously cause the slide seat 96 to slide downwardly on the apparatus frame 95 away from the assembly frame 2. This motion may be repeated for a selected number of repetitions and sets to primarily exercise and strengthen the chest and triceps muscles of the exerciser 66.

It will be appreciated by those skilled in the art that the exerciser 66 may carry out numerous other exercises by sitting, lying, or otherwise reclining on the slide seat 96 of the exercise apparatus 90 and working against the resistance imparted by the exerciser's body weight by grasping and pulling or pushing the outer handles 30 or the inner handles 38 of the exercise attachment assembly 1. Moreover, in some applications, the height of outer cable pulleys 26 and inner cable pulleys 34, as well as the distance therebetween, may be selectively adjusted by adjusting the height of the assembly frame 2 and/or the length of the cable support frame 20 to vary the trajectory, width and reach of the pulling motions exerted by the exerciser 66 against the outer handles 30 and/or the inner handles 38, typically as was heretofore described.

Referring next to FIGS. 5-9 of the drawings, an alternative illustrative embodiment of the exercise attachment assemblies is generally indicated by reference numeral 101. In the exercise attachment assembly 101, elements which are analogous to the respective elements of the exercise attachment assembly 1 that was heretofore described with respect to FIGS. 1-4 are designated by the same respective numerals in the 101-199 series in FIGS. 5-9. The exercise attachment assembly 101 may be configurable in the same manner as was heretofore described with respect to the exercise attachment assembly 1 to perform the same or similar exercises. Accordingly, to the extent applicable, the same description which was heretofore set forth with respect to the exercise attachment assembly 1 is incorporated by reference herein in its entirety with respect to the exercise attachment assembly 101.

Figure 5:
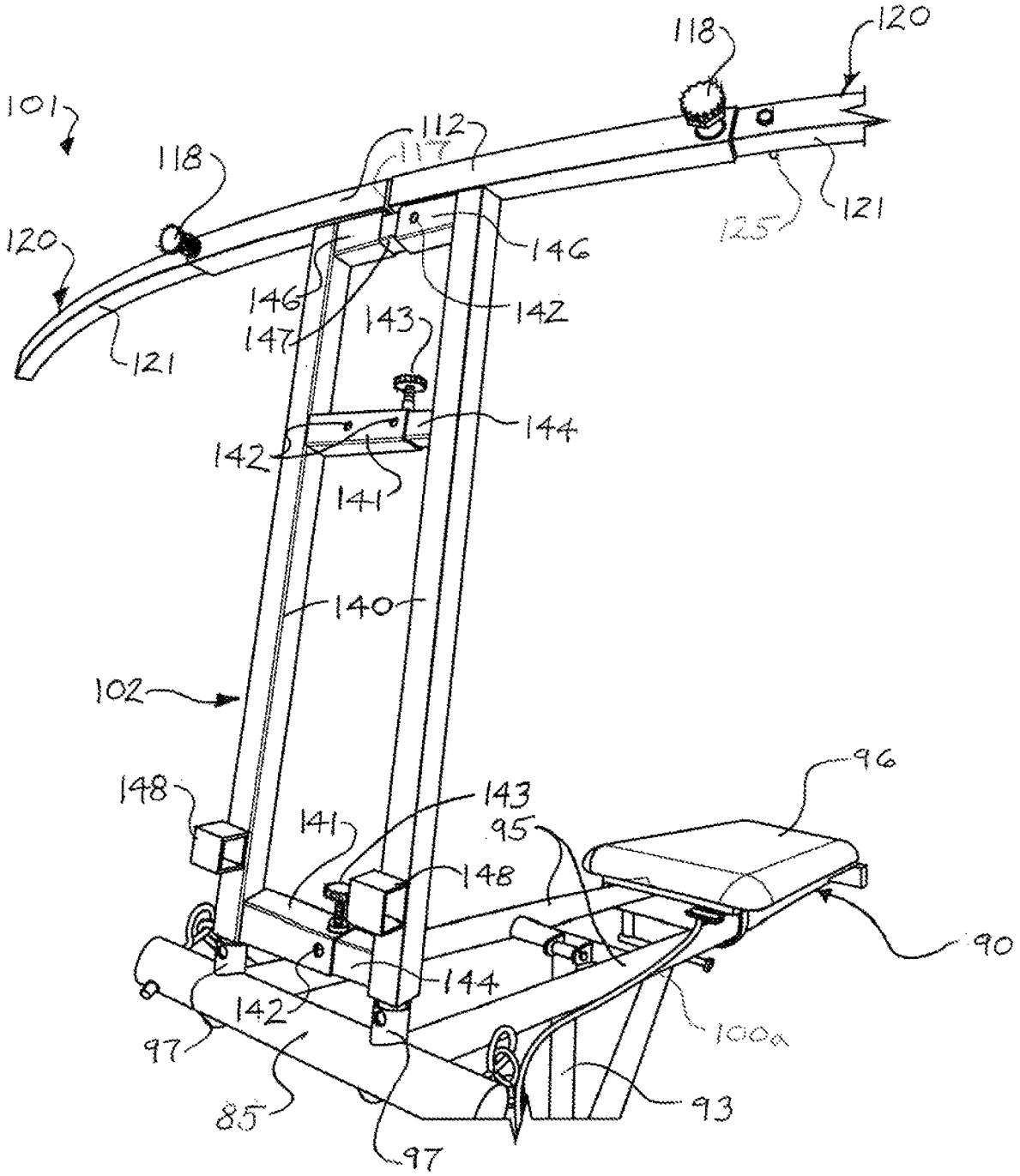
FIG. 5 is a sectioned front perspective view of an alternative illustrative embodiment of the exercise attachment assemblies, partially assembled on the slant carriage exercise apparatus (shown in section)

The assembly frame 102 of the exercise attachment assembly 101 may include a pair of elongated, parallel, spaced-apart main frame members 140. The main frame members 140 of the assembly frame 102 may be configured for attachment to the apparatus frame 95 of the exercise apparatus 90, such as via the frame collars 97 on the front frame member 85 of the apparatus frame 95. For example and without limitation, in some embodiments, the lower ends of the main frame members 140 may be sized and configured to receive and fit into the respective frame collars 97, as illustrated in FIG. 5. The cable support frame mount member 112 may be supported on the upper ends of the main frame members 140.

The cable support frame 120 may be supported by the cable support frame mount member 112. In some embodiments, the cable support frame 120 may include a main arm segment 121 which extends from a corresponding end of the cable support frame mount member 112. Each main arm segment 121 of the cable support frame 120 may be adjustably extendable with respect to the cable support frame 120. A frame adjusting knob 118 may be provided on the cable support frame mount member 112. Each frame adjusting knob 118 may be configured to selectively engage the corresponding main arm segment 121 to secure a selected length of the main arm segment 121 from the corresponding end of the cable support frame mount member 112 and achieve the desired length of the cable support frame 120.

In some embodiments, the width of the assembly frame 102 may be selected to accord with the distance between the frame collars 97 on the front frame member 85 of the exercise apparatus 90. Accordingly, at least one frame sleeve 141 may extend from a first one of the main frame members 140 of the assembly frame 102. At least one frame insertion arm 144 may extend from the other one of the main frame members 140. The frame sleeve 141 may telescopically receive the frame insertion arm 144. As illustrated in FIG. 5, a frame adjusting knob 143 may be loosened and tightened to vary the extended or retracted position of the frame insertion arm 144 with respect to the frame sleeve 141, and hence, the width of the assembly frame 102. Alternatively, a frame adjusting pin (not illustrated) may be extended through a selected one of multiple, spaced-apart pin openings 142 in the frame sleeve 141 and through a registering pin opening (not illustrated) in the frame insertion arm 144 to secure the frame sleeve 141 with respect to the frame insertion arm 144 at the selected extended or retracted length corresponding to the desired width of the assembly frame 102. The cable support frame mount member 112 of the assembly frame 102 may be fabricated in separate pieces and separated by a frame gap 117 to facilitate the adjustment in width of the assembly frame 102 as deemed necessary.

At the upper end of the assembly frame 102, a pair of upper frame sleeves 146 may extend from the respective main frame members 140. The upper frame sleeves 146 may telescopically receive a frame insertion arm 147. A frame adjusting pin (not illustrated) may be inserted through a pin opening 142 in each upper frame sleeve 146 and through a registering pin opening (not illustrated) in the frame insertion arm 147 to facilitate adjustment in width of the assembly frame 102.

Figure 6:
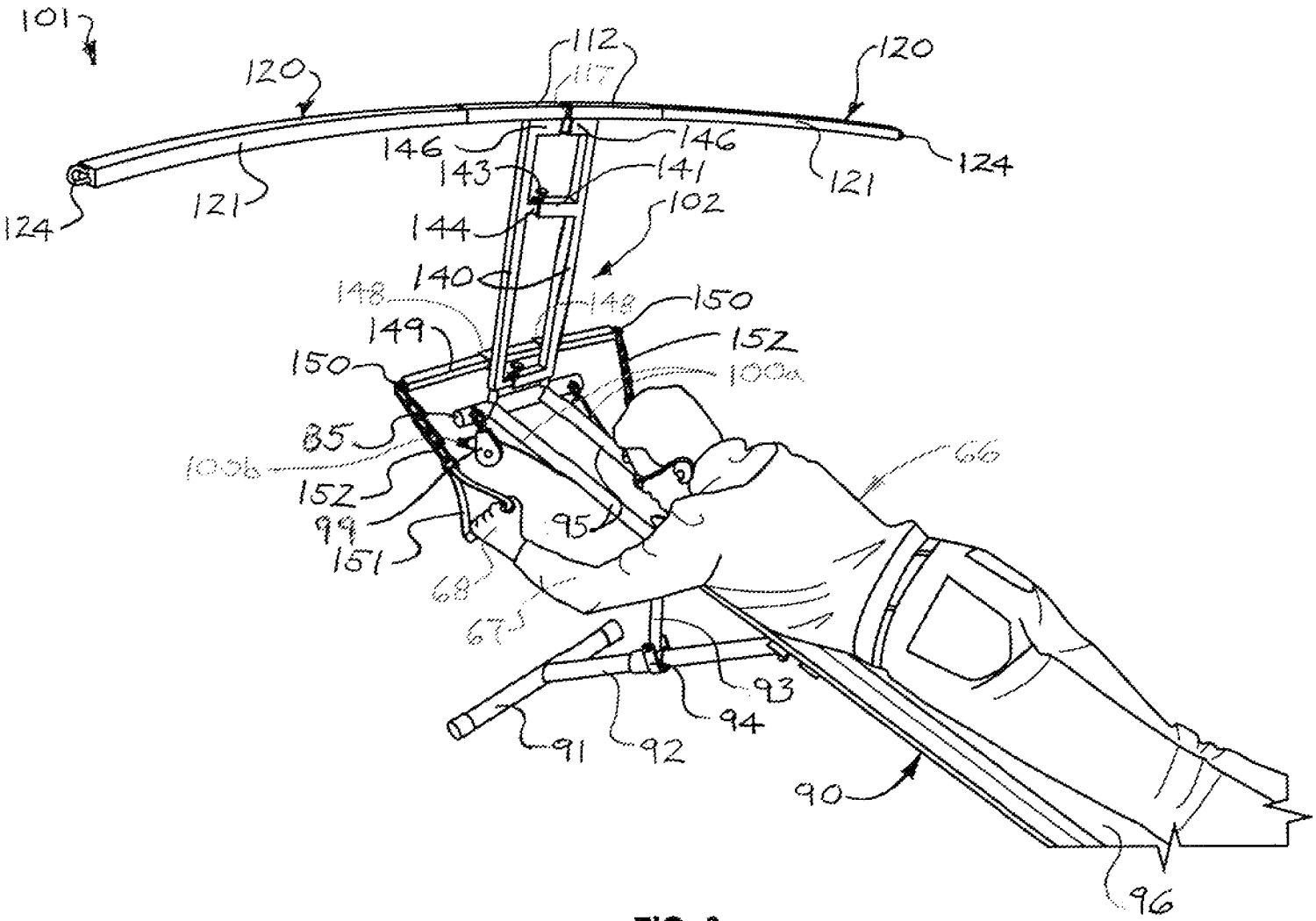
FIG. 6 is a rear perspective view of the illustrative exercise attachment assembly illustrated in FIG. 5, with the exerciser lying face-down on the slide seat of the slant carriage exercise apparatus while performing pulling exercises using a pair of pull handles attached to the assembly frame of the exercise attachment assembly.
Figure 7:
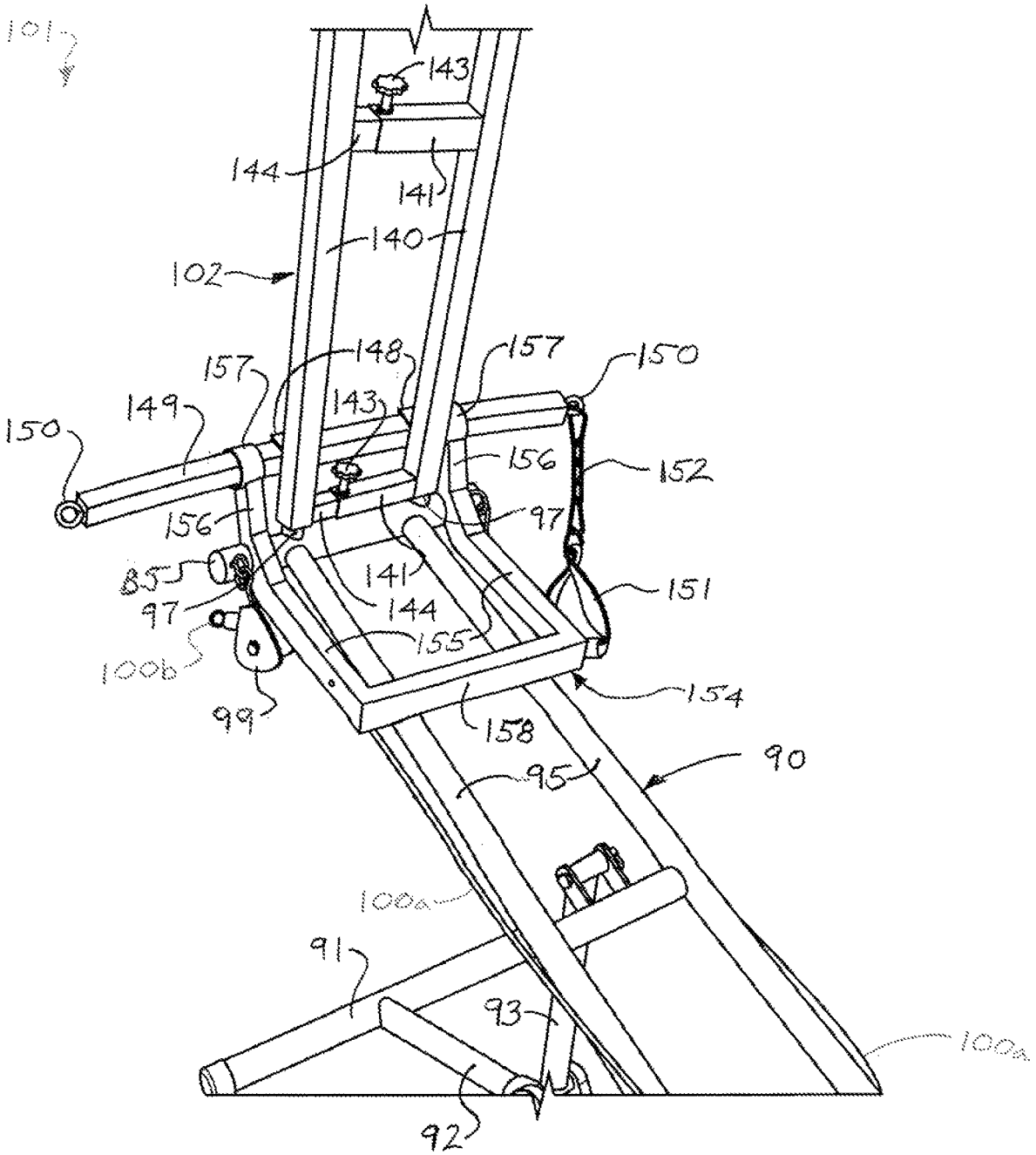
FIG. 7 is a rear perspective view, partially in section, of the illustrative exercise attachment assembly and slant carriage exercise apparatus illustrated in FIG. 5, with a typical armrest support frame mounted on the assembly frame of the exercise attachment assembly.
Figure 8:
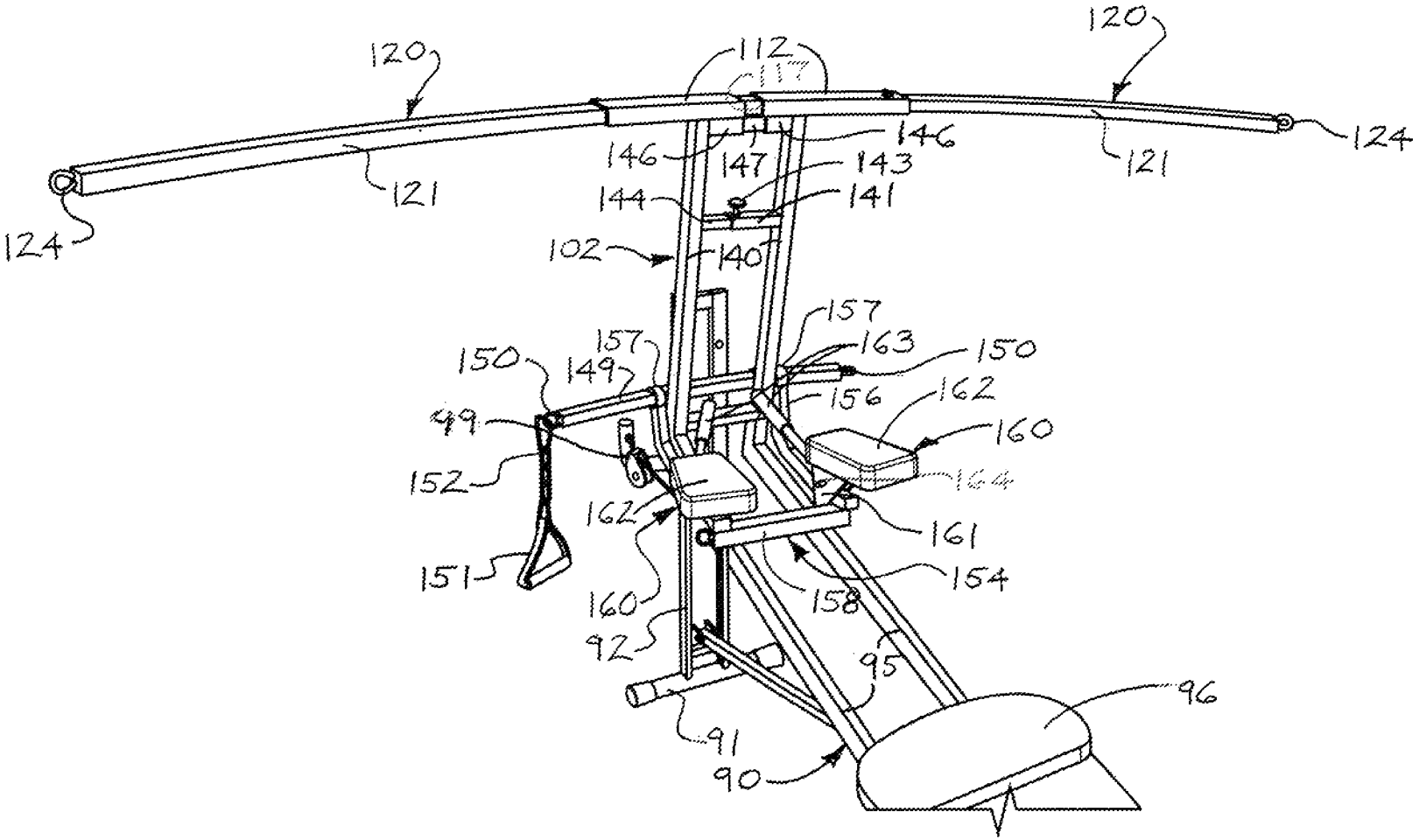
FIG. 8 is a rear perspective view of the illustrative exercise attachment assembly illustrated in FIG. 7, with a pair of armrests mounted on the armrest support frame.

As particularly illustrated in FIG. 5, in the exercise attachment assembly 101, at least one pull handle collar 148 may be provided on the assembly frame 102. As illustrated, in some embodiments, a pair of spaced-apart pull handle collars 148 may extend forwardly from the respective main frame members 140 of the assembly frame 102 in aligned or registering relationship to each other. As illustrated in FIGS. 6-8, at least one pull handle member 149 may be configured for insertion through the pull handle collars 148. A pair of pull handles 151 may be attached to the pull handle member 149 such as via a respective pair of pull handle attachment members 152 attached to respective pull handle hooks 150.

As illustrated in FIG. 6, in typical application of the exercise attachment assembly 101, an exerciser 66 may lie face-down on the slide seat 96 of the exercise apparatus 90 and grasp the pull handles 151 with the exerciser's hands 68. The exerciser 66 may repeatedly pull against the pull handles 151 to traverse the slide seat 96 upwardly on the apparatus frame 95 and relax the pulling motion to traverse the slide seat 96 downwardly on the apparatus frame 95 against the resistance imparted by the weight of the exerciser 66. This motion may be repeated for a selected number of repetitions and sets to exercise the arms and shoulders of the exerciser 66.

Figure 9:
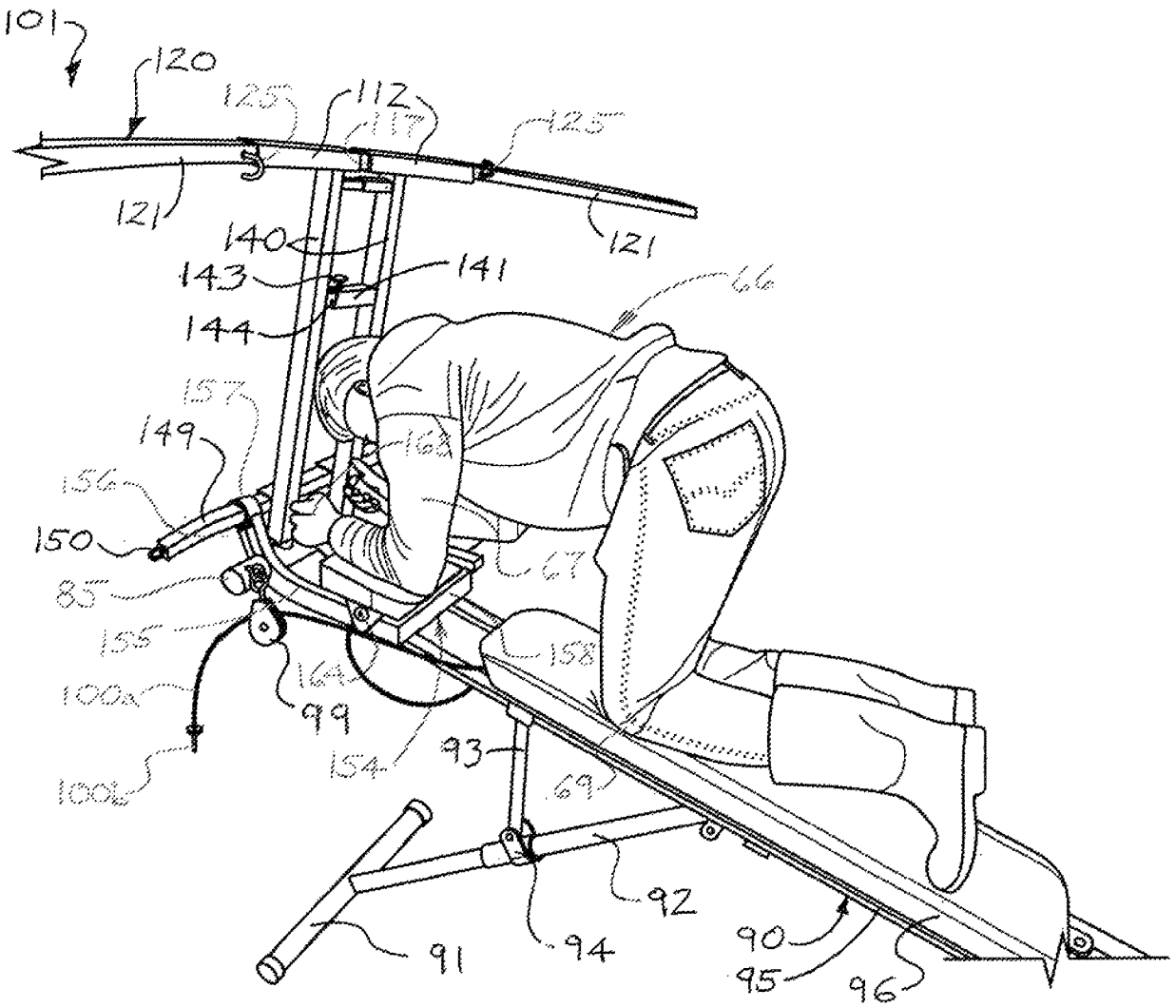
FIG. 9 is a side perspective view of the illustrative exercise attachment assembly illustrated in FIG. 8, with the knees of the exerciser resting on the slide seat of the slant carriage exercise apparatus and the elbows of the exerciser resting on the respective armrests of the assembly as the exerciser performs abdominal exercises.

As illustrated in FIGS. 7-9, in some applications, a pair of armrests 160 (FIG. 8) may be deployed on the assembly frame 102. The armrests 160 may enable the exerciser 66 to perform abdominal exercises on the exercise apparatus 90, as illustrated in FIG. 9. Accordingly, as illustrated in FIG. 7, an armrest support frame 154 may initially be deployed in place on the armrest frame 102. The armrest support frame 154 may include a pair of elongated, parallel, spaced-apart frame arms 155. A pair of arm extensions 156 may extend at an upward angle from the respective frame arms 155. A pair of armrest frame collars 157 may terminate the respective arm extensions 156. In some embodiments, the frame arms 155 and the arm extensions 156 may be sufficiently spaced apart from each other to extend on opposite sides of the respective main frame members 140 of the assembly frame 102, as illustrated. In other embodiments, the frame arms 155 and arm extensions 156 may be sufficiently spaced apart from each other to extend inside the respective main frame members 140 of the assembly frame 102. Each armrest frame collar 157 may be suitably sized and configured to receive the pull handle member 149 as the pull handle member 149 is extended through the pull handle collars 148 on the assembly frame 102. A frame connector 158 may extend between the frame arms 155. The frame connector 158 may rest on the apparatus frame 95 of the exercise apparatus 90.

As illustrated in FIGS. 8 and 9, each armrest 160 may include an armrest mount bracket 161. The armrest mount bracket 161 may be sized and configured for attachment to the corresponding frame arm 155 of the armrest support frame 154 such as via an armrest pin 164, for example and without limitation. An armrest pad 162 may be provided on each armrest mount bracket 161. An armrest handle 163 may extend forwardly from the armrest mount bracket 161 of each armrest 160.

As illustrated in FIG. 9, the exerciser 66 may initially rest the knees 69 on the slide seat 96 of the exercise apparatus 90. The exerciser 66 may rest the forearms of the arms 67 on the armrest pads 162 of the respective armrests 160 and grip the respective armrest handles 163. The exerciser 66 may then repeatedly raise the slide seat 96 up the slope of the apparatus frame 95 and lower the slide seat 96 downwardly on the apparatus frame 95 to exercise the abdominal muscles.

After use of the exercise attachment assembly 1, the armrests 160 may be removed from the assembly frame 102 by removing the pull handle member 149 from the pull handle collars 148 on the assembly frame 102 and the armrest frame collars 157 of the armrest support frame 154 and the armrest support frame 154 lifted and removed from the apparatus frame 95 of the exercise apparatus 90. Each armrest 160 may be removed from the armrest support frame 154 typically by removing the armrest pin 164 from the armrest mount bracket 161.

Referring next to FIGS. 10-17B of the drawings, another alternative illustrative embodiment of the exercise attachment assemblies is generally indicated by reference numeral 201. In the exercise attachment assembly 201, elements which are analogous to the respective elements of the exercise attachment assembly 1 that was heretofore described with respect to FIGS. 1-4 are designated by the same respective numerals in the 201-299 series in FIGS. 10-17B. Elements which are analogous to the respective elements of the exercise attachment assembly 101 that was heretofore described with respect to FIGS. 5-9 are designated by the same respective numerals in the 201-299 series in the exercise attachment assembly 201 illustrated in FIGS. 10-17B. The exercise attachment assembly 201 may be configurable in the same manner as was heretofore described with respect to the exercise attachment assembly 1 and the exercise attachment assembly 101 to perform the same or similar exercises. Accordingly, to the extent applicable, the same description which was heretofore set forth with respect to the exercise attachment assembly 1 and with respect to the exercise attachment assembly 101 is incorporated by reference herein in its entirety with respect to the exercise attachment assembly 201.

Figure 10:
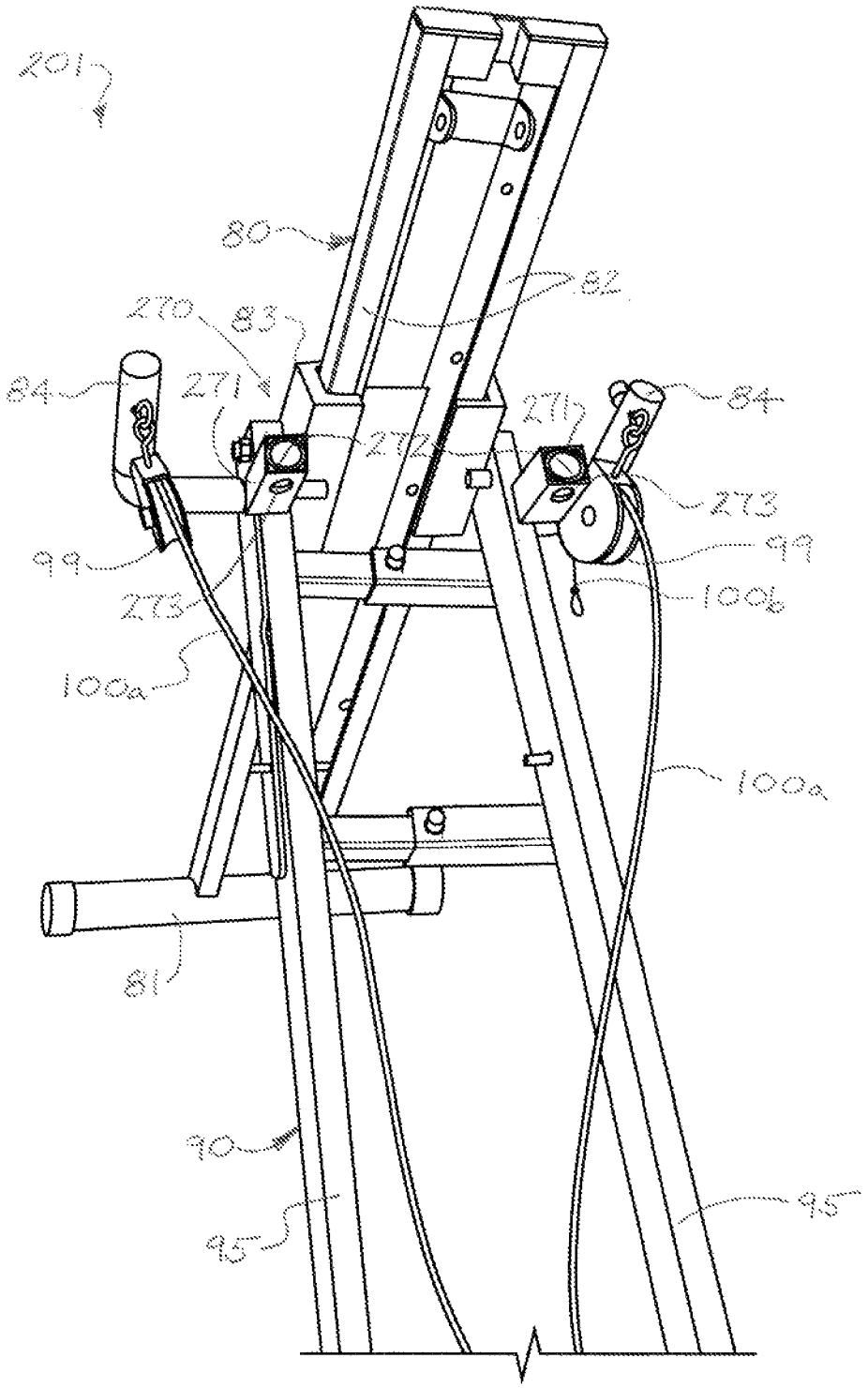
FIG. 10 is a rear perspective view of another type of slant carriage exercise apparatus (shown in section) with a typical frame support assembly of another alternative illustrative embodiment of the exercise attachment assemblies partially assembled on the slant carriage exercise apparatus.

As illustrated in FIG. 10, the exercise apparatus 90 to which the exercise attachment assembly 201 is attached may be standard or conventional and may include a front slant carriage support 80. The front slant carriage support 80 may be configured to support the front end of the apparatus frame 95. The front slant carriage support 80 may include a base support member 81 which rests on the ground, floor, or other support surface (not illustrated). A pair of elongated, parallel, spaced-apart vertical support members 82 may extend upwardly from the base support member 81. A frame support bracket 83 may be provided on the vertical support members 82. The front end of the apparatus frame 95 may rest on the frame support bracket 83. The frame support bracket 83 may be adjustably mounted on the vertical support members 82 according to the knowledge of those skilled in the art. A pair of front handles 84 may extend outwardly and upwardly from the respective sides of the apparatus frame 95 at or adjacent to the frame support bracket 83.

The exercise attachment assembly 201 may include a frame support assembly 270. The frame support assembly 270 may be configured to support the assembly frame 202 of the frame support assembly 270 on the apparatus frame 95 of the exercise apparatus 90. As illustrated in FIG. 10, the frame support assembly 270 may include at least one, and typically, a pair of spaced-apart support bases 271 extending upwardly from the apparatus frame 95, Each support base 271 may be attached to the apparatus frame 95 via welding, a pinned connection, mechanical fasteners and/or other suitable attachment technique known by those skilled in the art. Each support base 271 may have at least one support base opening 272. A pin opening 273 may extend into a side of each support base 271. The pin opening 273 may communicate with the support base opening 272.

Figure 11A:
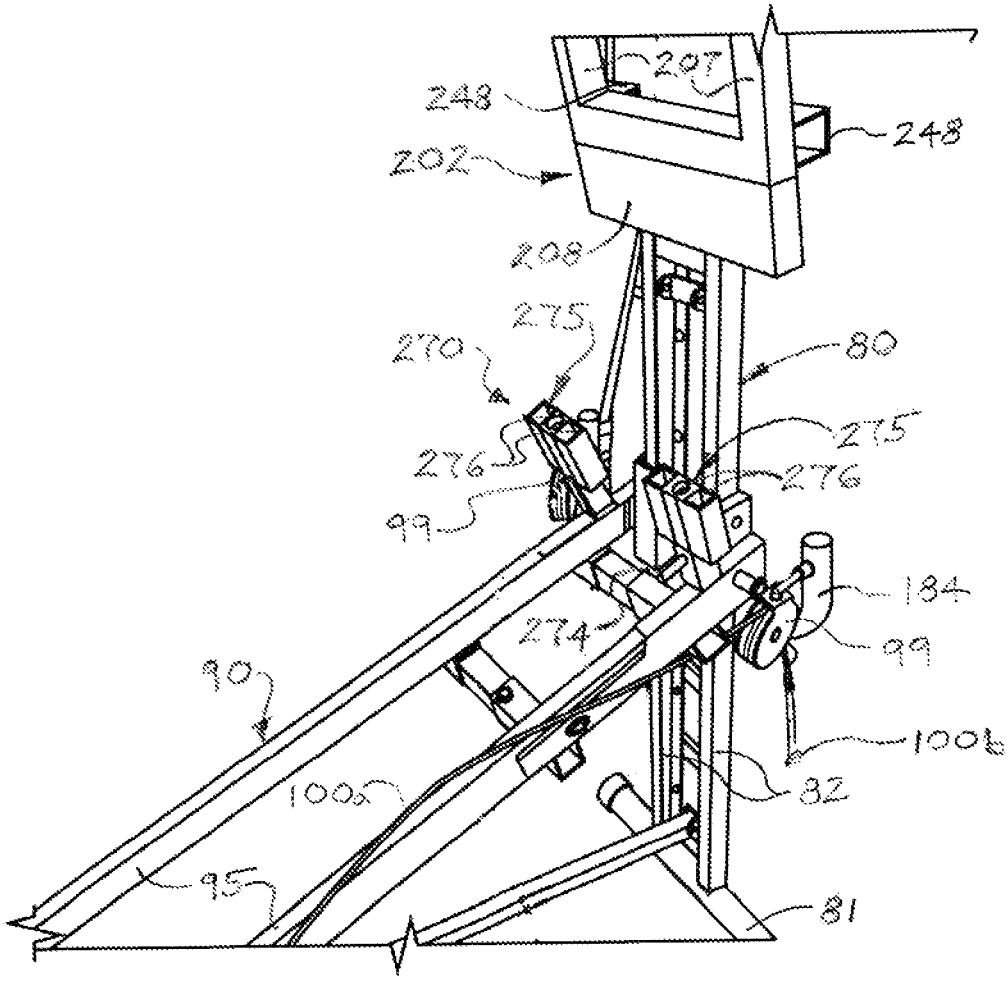
FIG. 11A is a rear perspective view of the slant carriage exercise apparatus illustrated in FIG. 10, with the frame support assembly deployed in place on the apparatus, more particularly illustrating typical lowering of an assembly frame (partially in section) of the exercise attachment assembly on the frame support assembly.
Figure 11C:
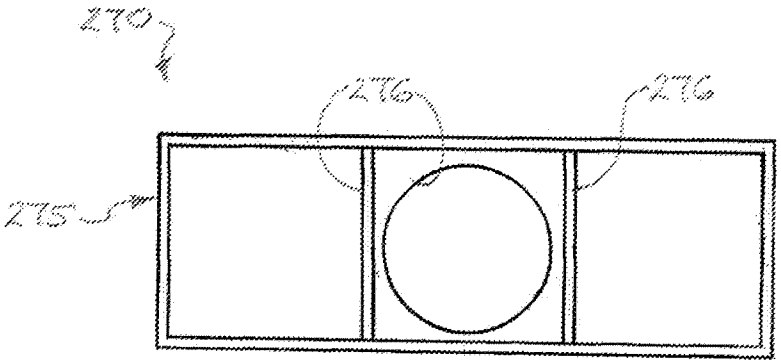
FIG. 11C is a top view of a frame support block of the frame support assembly of the exercise attachment assembly illustrated in FIG. 10.
Figure 11B:
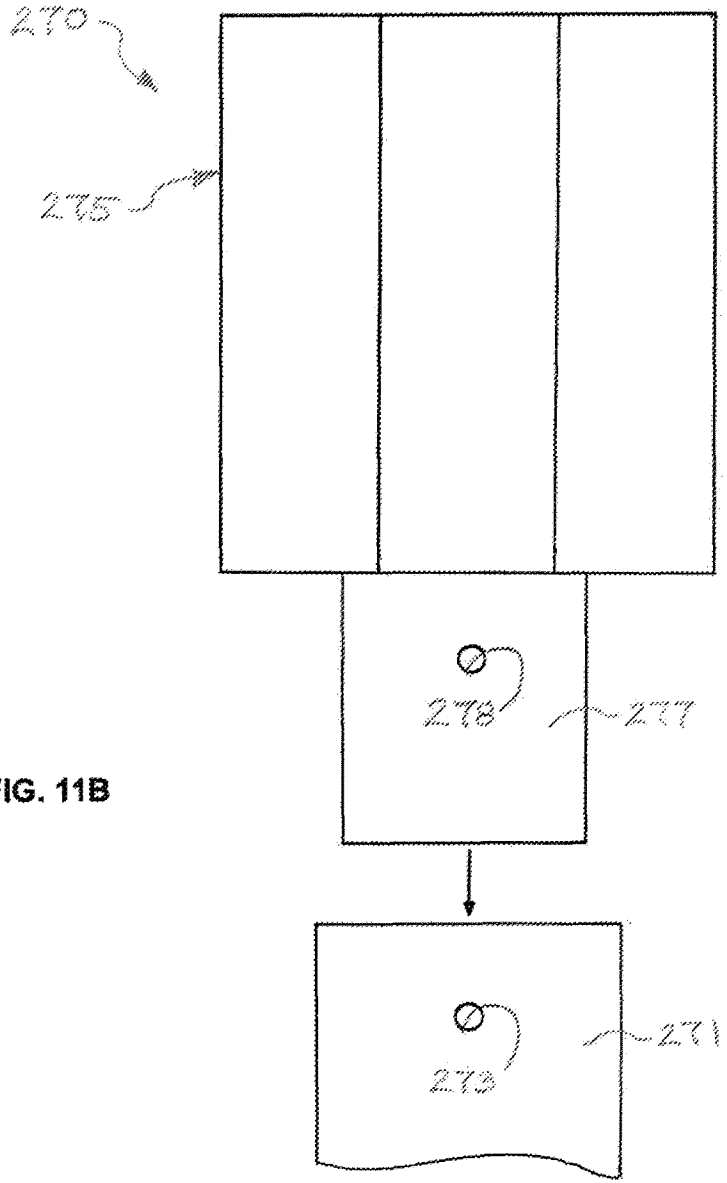
FIG. 11B is an exploded front view illustrating typical attachment of a frame support block of a frame support assembly to a corresponding support base on the slant carriage exercise apparatus in assembly of the exercise attachment assembly illustrated in FIG. 10.

As illustrated in FIG. 11A, a frame support block 275 may be supported by each support base 271. As illustrated in FIG. 11B, a support block nipple 277 may extend downwardly from each frame support block 275. The support block nipple 277 may be sized and configured to insert into the support base opening 272 (FIG. 10) of each support base 271. The support block nipple 277 may have a pin opening 278. Accordingly, as illustrated in FIG. 11A, a block pin 274 may be extended through the pin opening 273 in each support base 271 and the registering pin opening 278 in each corresponding support block nipple 277 to secure each frame support block 275 in place on each corresponding support base 271. As illustrated in FIG. 11C, at least one, and typically, multiple support block openings 276, the purpose of which will be hereinafter described, may be provided in each frame support block 275.

Figure 12:
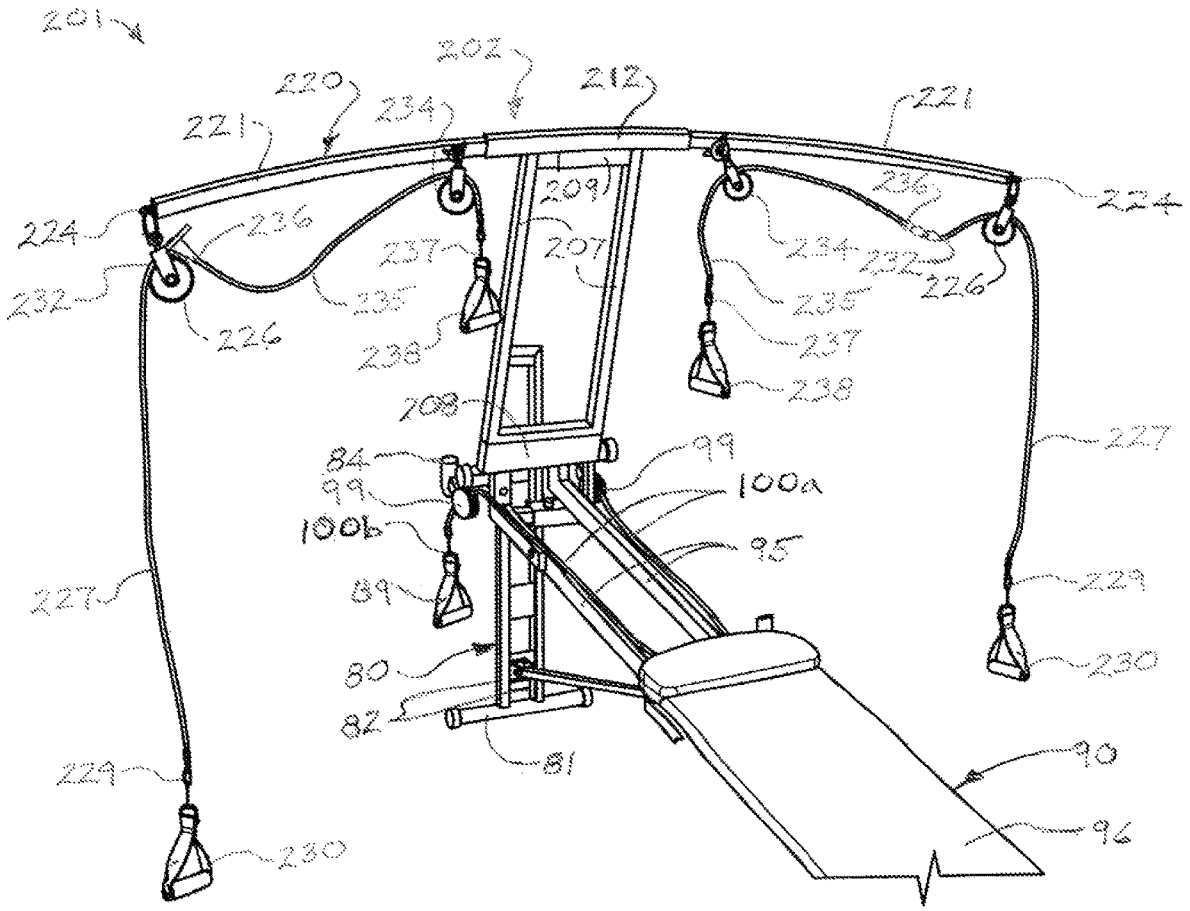
FIG. 12 is a rear perspective view of the illustrative exercise attachment assembly illustrated in FIG. 10, more particularly illustrating a typical configuration for performing pulling exercises using a pair of pull handles attached to the respective main cables of the slant carriage exercise apparatus.

As illustrated in FIG. 12, the assembly frame 202 of the exercise attachment assembly 201 may include a horizontal bottom frame member 208. A pair of elongated, parallel, spaced-apart vertical frame members 207 may extend upwardly from the bottom frame member 208. A horizontal top frame member 209 may extend between the vertical frame members 207. In some embodiments, the top frame member 209 may be telescopically length adjustable. The cable support frame mount member 212 may be supported by the top frame member 209 and/or the upper ends of the vertical frame members 207. The cable support frame 220 which supports the outer cable pulleys 226 and the inner cable pulleys 234 may include a pair of main arm segments 221 which extend from the opposite ends of the cable support frame mount member 212. In some embodiments, the main arm segments 221 of the cable support frame 220 may be telescopically length adjustable with respect to each corresponding end of the cable support frame mount member 212.

As illustrated in FIG. 11A, the bottom frame member 208 of the assembly frame 202 may be sized and configured to receive the frame support blocks 275 of the frame support assembly 270. The bottom frame member 208 of the assembly frame 202 may engage the support block openings 276 in each frame support block 275. For example and without limitation, in some embodiments, the interior of the bottom frame member 208 may include frame elements (not illustrated) which are sized and shaped or configured to insert into the respective support block openings 276 in each frame support block 275 as the bottom frame member 208 is lowered in place over the frame support blocks 275.

As illustrated in FIGS. 12-16, the exercise attachment assembly 201 may be selectively configured to enable an exerciser 66 to perform various upper body strengthening exercises. For example and without limitation, as illustrated in FIG. 12, in some applications, a pair of pull handles 89 may be attached to the main cables 100*a* of the exercise apparatus 90 at the respective main cable connectors 100*b*. The pull handles 89 may be grasped by the exerciser 66 as the exerciser 66 typically lies face down or sits on the slide seat 96 of the exercise apparatus 90 and pulls against the pull handles 89 against the resistance imparted by the weight of the exerciser 66 to hoist the slide seat 96 up the apparatus frame 95.

Figure 13:
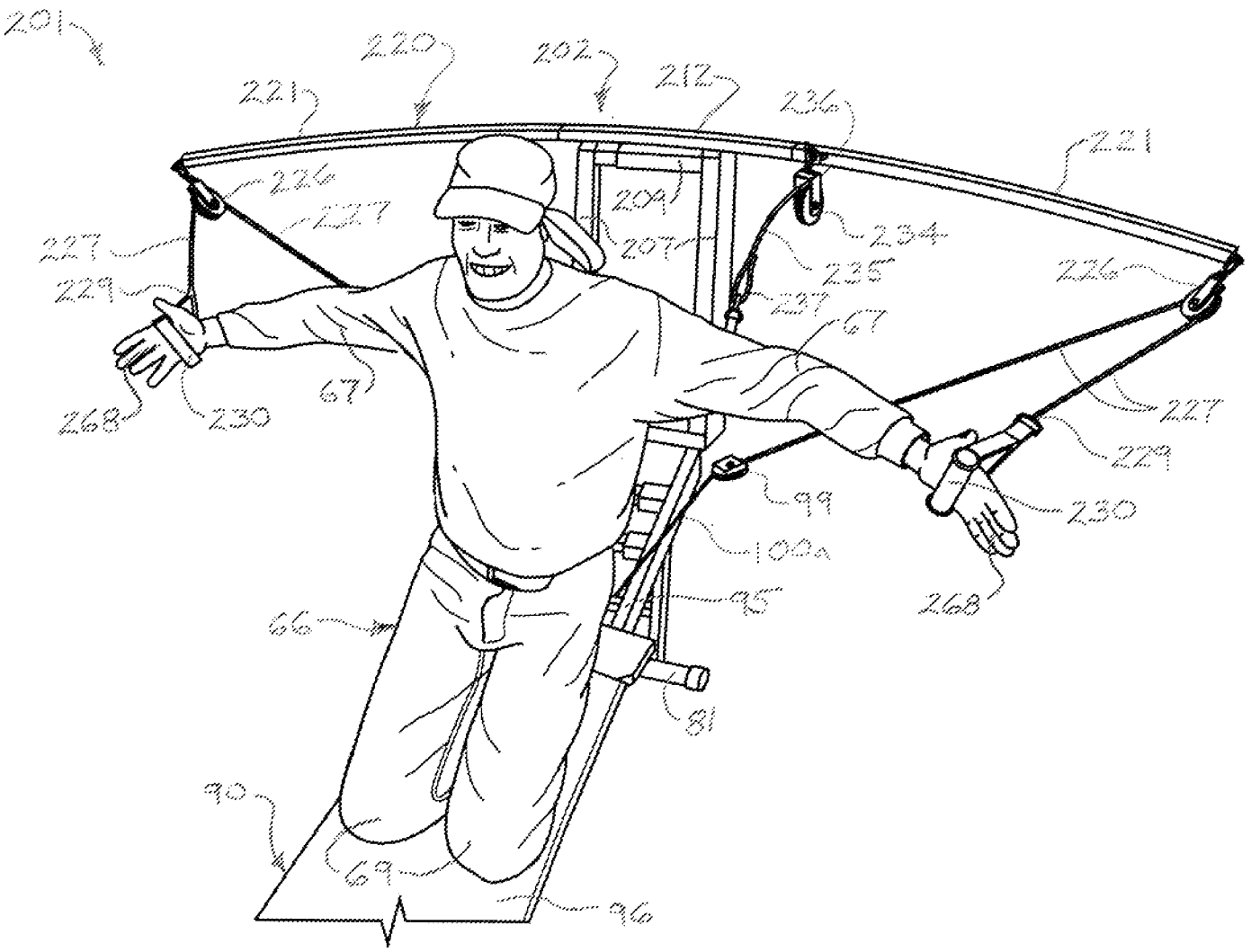
FIG. 13 is a rear perspective view of the illustrative exercise attachment assembly illustrated in FIG. 10, with the rearward-facing exerciser resting on the exerciser's knees on the slide seat of the slant carriage exercise apparatus while performing wide-motion pulling exercises by gripping and pulling the outer handles attached to the respective outer cables of the assembly.

As illustrated in FIG. 13, in some applications, the outer cables 277 may be coupled to the respective main cables 100*a* of the exercise apparatus 90. The exerciser 66 may grasp the respective outer handles 230 and rest on the knees 69, facing rearwardly on the slide seat 96 of the exercise apparatus 90. The exerciser 66 may repeatedly pull the outer handles 230 from the sides forwardly to the front of the midline of the exerciser 66 as the outer cables 227 hoist the slide seat 96 up the apparatus frame 95 against the resistance imparted by the weight of the exerciser 66 to exercise the arms, shoulders and chest of the exerciser 66.

Figure 14:
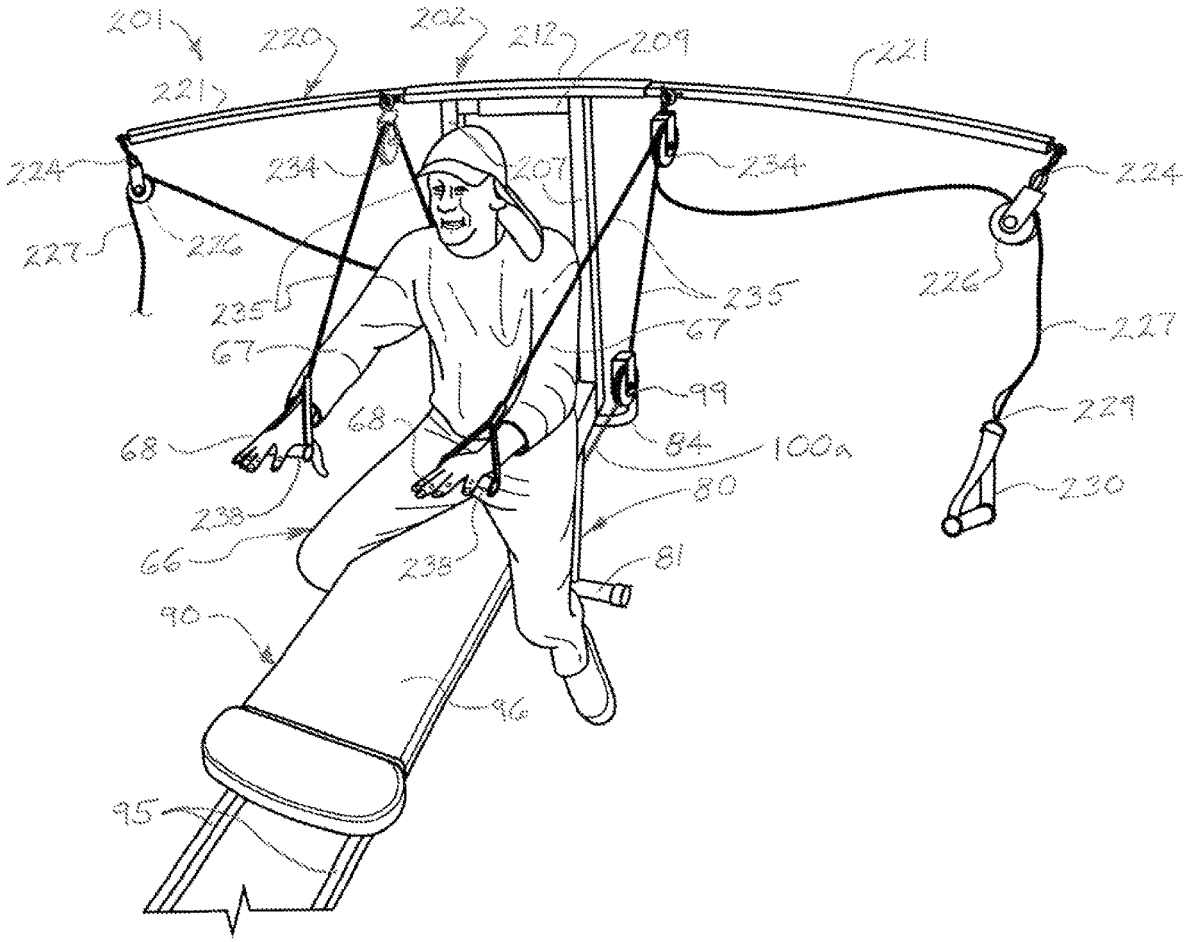
FIG. 14 is a rear perspective view of the illustrative exercise attachment assembly illustrated in FIG. 10, with the rearward-facing exerciser sitting on the slide seat of the slant carriage exercise apparatus while performing narrow-motion pushing exercises by gripping and pushing the inner handles attached to the respective inner cables of the assembly.

As illustrated in FIG. 14, in some applications, the exerciser 66 may perform narrow-motion arm and chest exercises which focus on strengthening the triceps and chest of the exerciser 66. Accordingly, the inner cables 235 may be attached to the main cables 100*a* of the exercise apparatus 90 at the respective inner cable connectors (not illustrated in FIG. 14). The exerciser 66 may initially grasp the inner handles 238 and then sit in the reverse direction on the slide seat 96 of the exercise apparatus 90. With the arms 67 initially pulled rearwardly with the exerciser's hands 68 typically adjacent to the exerciser's torso, the exerciser 266 may then push the inner handles 238 forwardly away from the respective sides of the exerciser's torso. Simultaneously, the inner cables 227 may traverse the respective inner cable pulleys 234 as the inner cables 227 pull against the respective main cables 100*a* of the exercise apparatus 90. The inner cables 227 may thus pull the slide seat 90 up the inclined apparatus frame 95 toward the assembly frame 202, via the respective main cables 100*a*, against the resistance imparted by the body weight of the exerciser 66. After the exerciser 66 has pushed the inner handles 238 adjacent to each other in front of the midline of the exerciser's torso, the exerciser 66 may then reverse the motion as the exerciser 66 reverses the position of the arms 267 back to the respective sides of the exerciser 66 against the resistance imparted by the exerciser's weight. Accordingly, the weight of the exerciser 66 may simultaneously cause the slide seat 96 to slide downwardly on the apparatus frame 95 away from the assembly frame 202. This motion may be repeated for a selected number of repetitions and sets to primarily exercise and strengthen the chest and triceps muscles of the exerciser 66.

Figure 15:
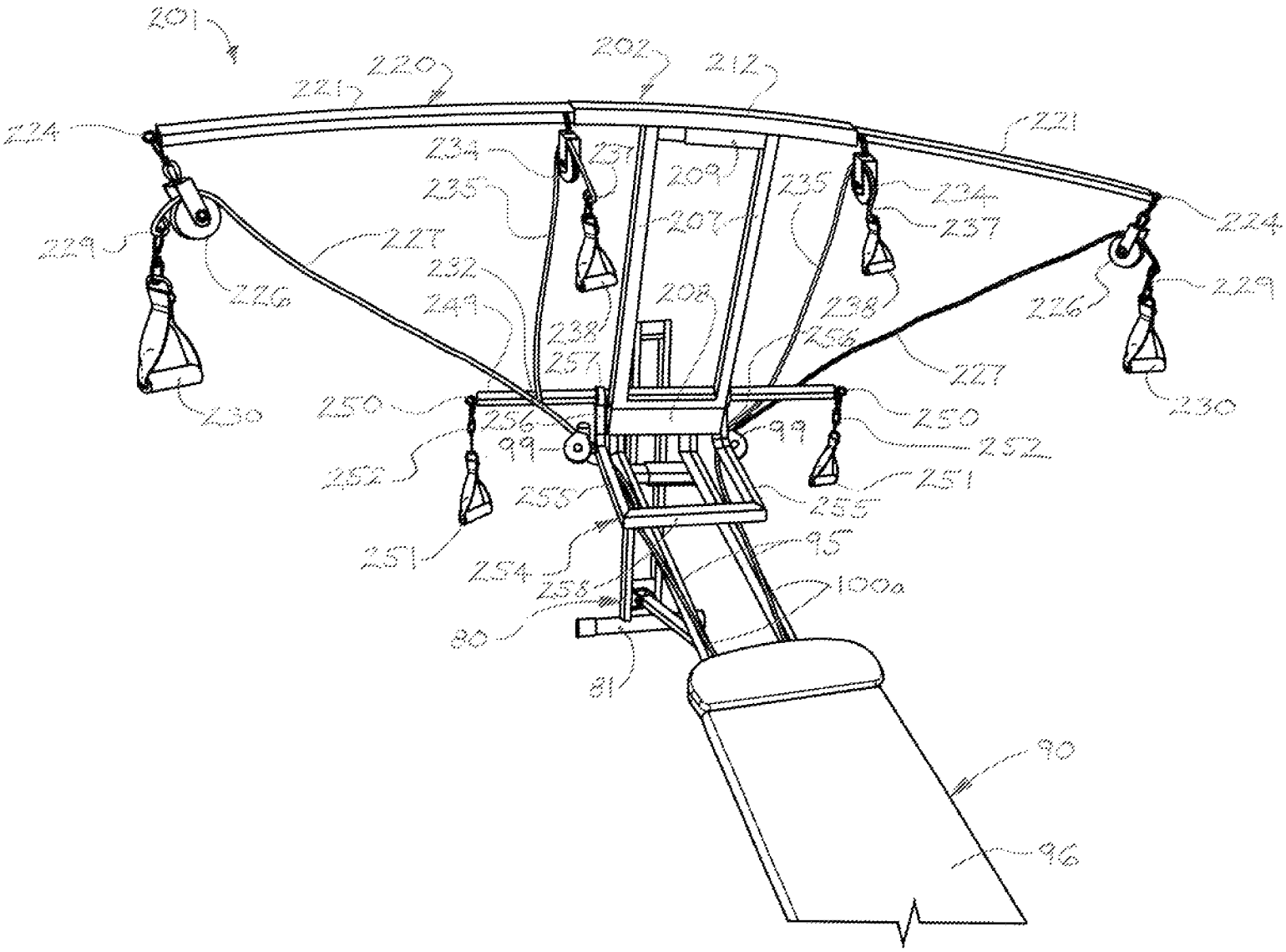
FIG. 15 is a rear perspective view of the illustrative exercise attachment assembly illustrated in FIG. 10, with a pull handle member mounted on the assembly frame of the exercise attachment assembly, a pair of pull handles attached to the pull handle member and a typical armrest support frame mounted on the pull handle member.
Figure 16:
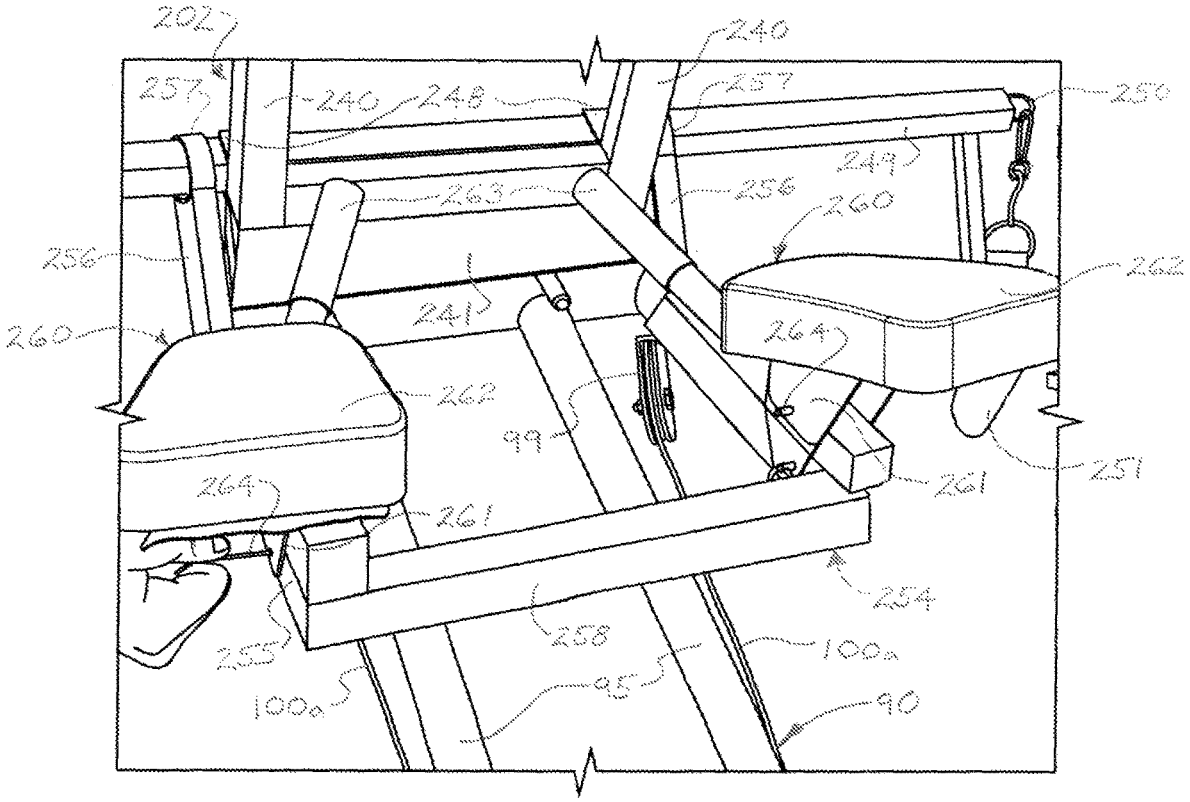
FIG. 16 is an enlarged rear perspective view of a pair of armrests attached to the armrest support frame of the illustrative exercise attachment assembly illustrated in FIG. 15.

As illustrated in FIG. 16, in some embodiments, at least one pull handle collar 248 may be provided on the assembly frame 202. As illustrated, in some embodiments, a pair of spaced-apart pull handle collars 248 may extend forwardly from the respective main frame members 240 of the assembly frame 202 in aligned or registering relationship to each other. As illustrated in FIG. 15, at least one pull handle member 249 may be configured for insertion through the pull handle collars 248. A pair of pull handles 251 may be attached to the pull handle member 249 such as via a respective pair of pull handle attachment members 252 attached to respective pull handle hooks 250. Accordingly, the exerciser 66 may lie face down on the slide seat 96 of the exercise apparatus 90, grasp the pull handles 251 and repeatedly pull up against the resistance imparted by the body weight of the exerciser 66 as the slide seat 96 traverses the apparatus frame 95 of the exercise apparatus 90, typically as was heretofore described with respect to FIG. 6.

As illustrated in FIGS. 15-17B, in some applications, the armrest support frame 254 may be deployed in place on the pull handle member 249 and the apparatus frame 95 of the exercise apparatus 90 and the armrests 260 attached to the armrest support frame 254, typically as was heretofore described with respect to the exercise attachment assembly 101 in FIGS. 7-9. The armrests 260 may enable the exerciser 66 to perform abdominal exercises, typically as was heretofore described with respect to the apparatus 101 in FIG. 9.

Figure 17A:
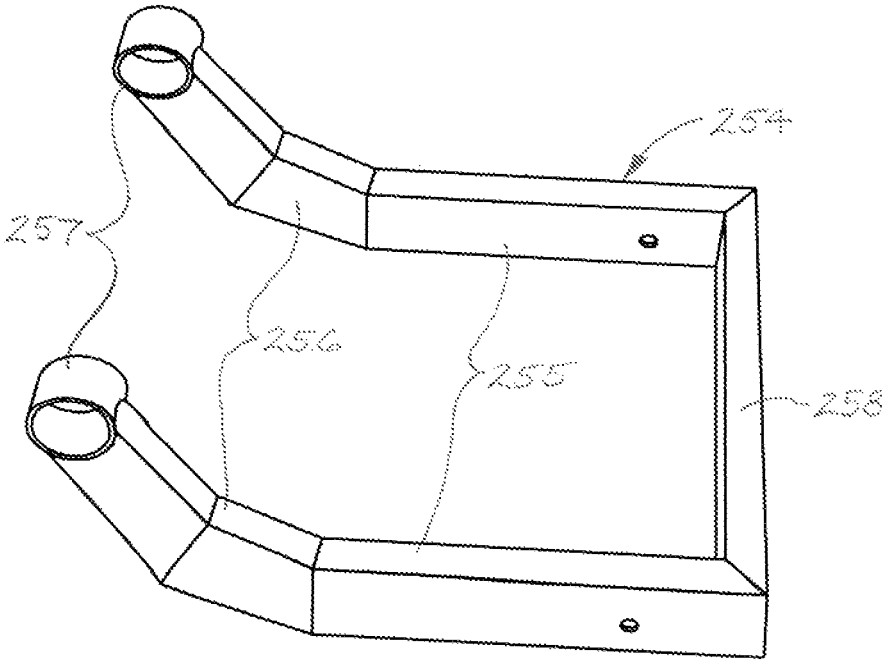
FIG. 17A is a perspective view of a typical armrest support frame suitable for supporting the armrests of the exercise attachment assembly illustrated in FIG. 16.
Figure 17B:
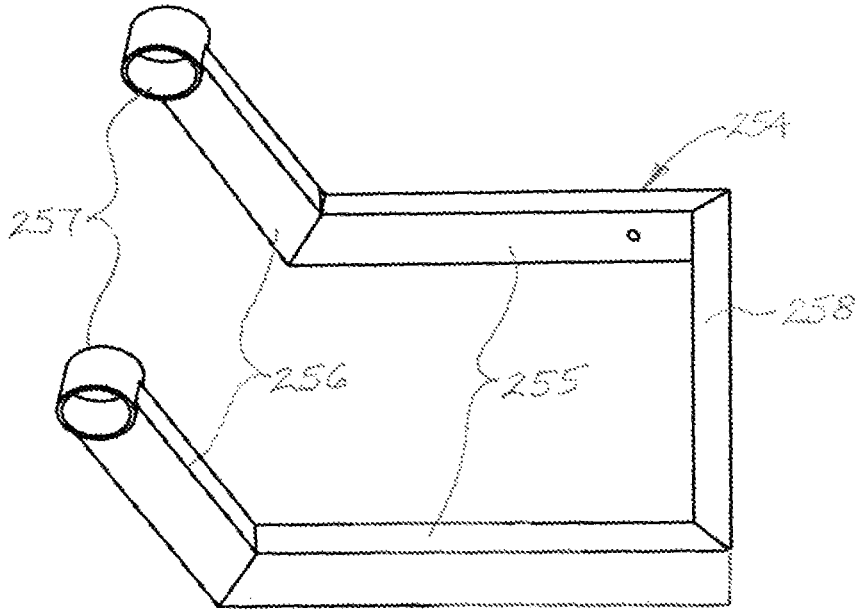
FIG. 17B is a perspective view of an alternative armrest support frame.

As illustrated in FIGS. 17A and 17B, the armrest support frame 254 for the armrests 260 may have different designs. For example, the armrest support frame 254 illustrated in FIG. 17A may be sized and configured such that the frame arms 255 and the frame arm extensions 256 fit on the exterior sides of the apparatus frame 95 of the exercise apparatus 90 when the armrest support frame 254 is deployed in place on the assembly frame 202 of the exercise attachment assembly 201 and the apparatus frame 95 of the exercise apparatus 90. The armrest support frame 254 illustrated in FIG. 17B may be sized and configured such that the frame arms 255 and the frame arm extensions 256 fit on the interior sides, or between the rails, of the apparatus frame 95 when the armrest support frame 254 is in place on the assembly frame 202 and the apparatus frame 95.

Figure 18:
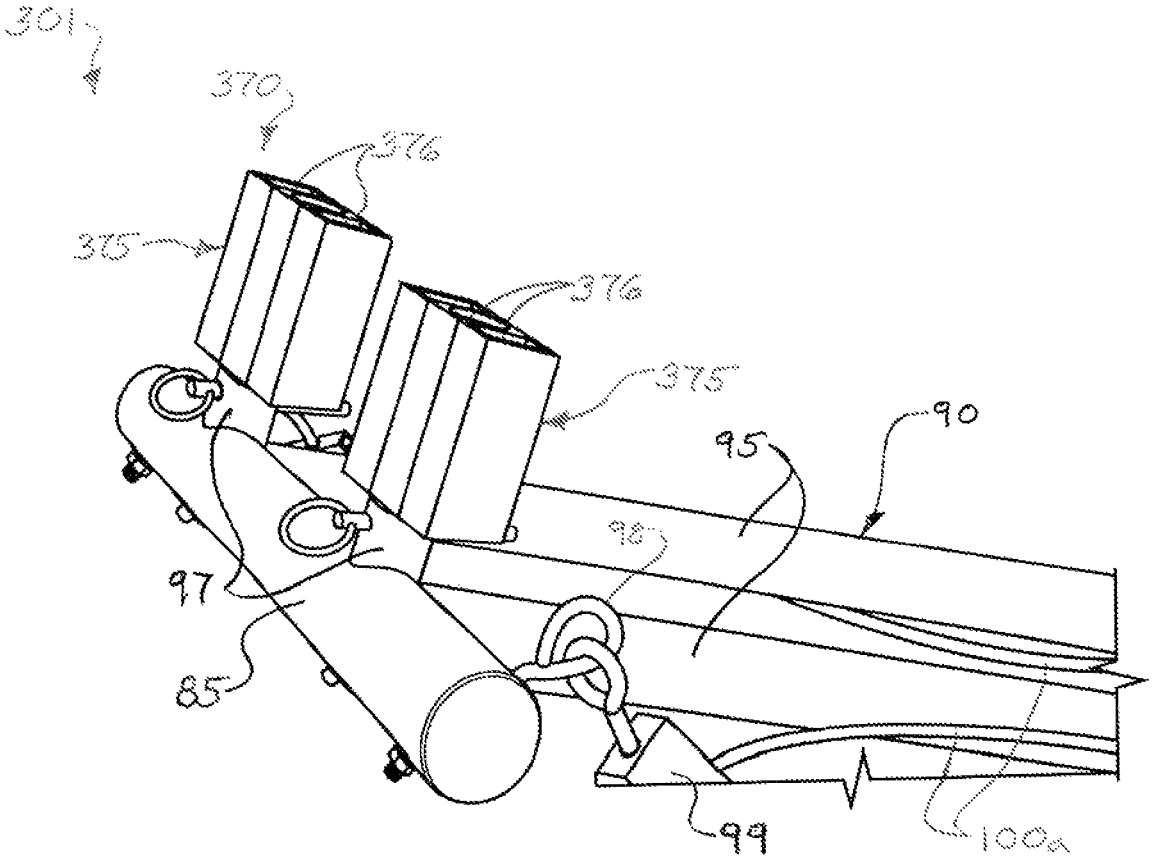
FIG. 18 is a front perspective view of a pair of frame support blocks of the frame support assembly mounted on a slant carriage exercise apparatus of the type illustrated in FIGS. 1-4, preparatory to mounting the assembly frame of the exercise attachment assembly illustrated in FIG. 12 on the frame support assembly.
Figure 19:
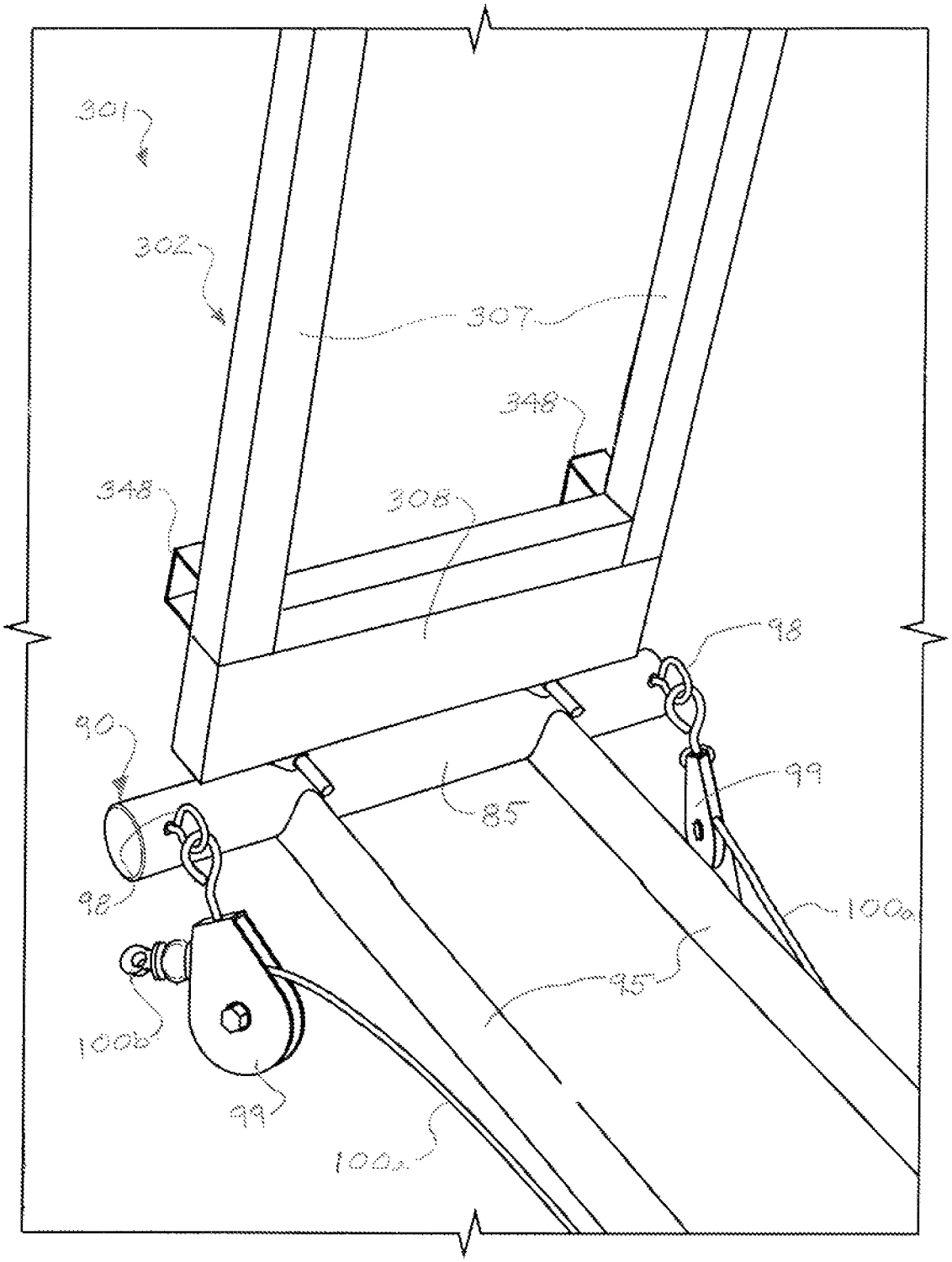
FIG. 19 is a rear perspective view of the assembly frame of the exercise attachment assembly mounted on the slant carriage exercise apparatus via the frame support assembly illustrated in FIG. 18.
Figure 20:
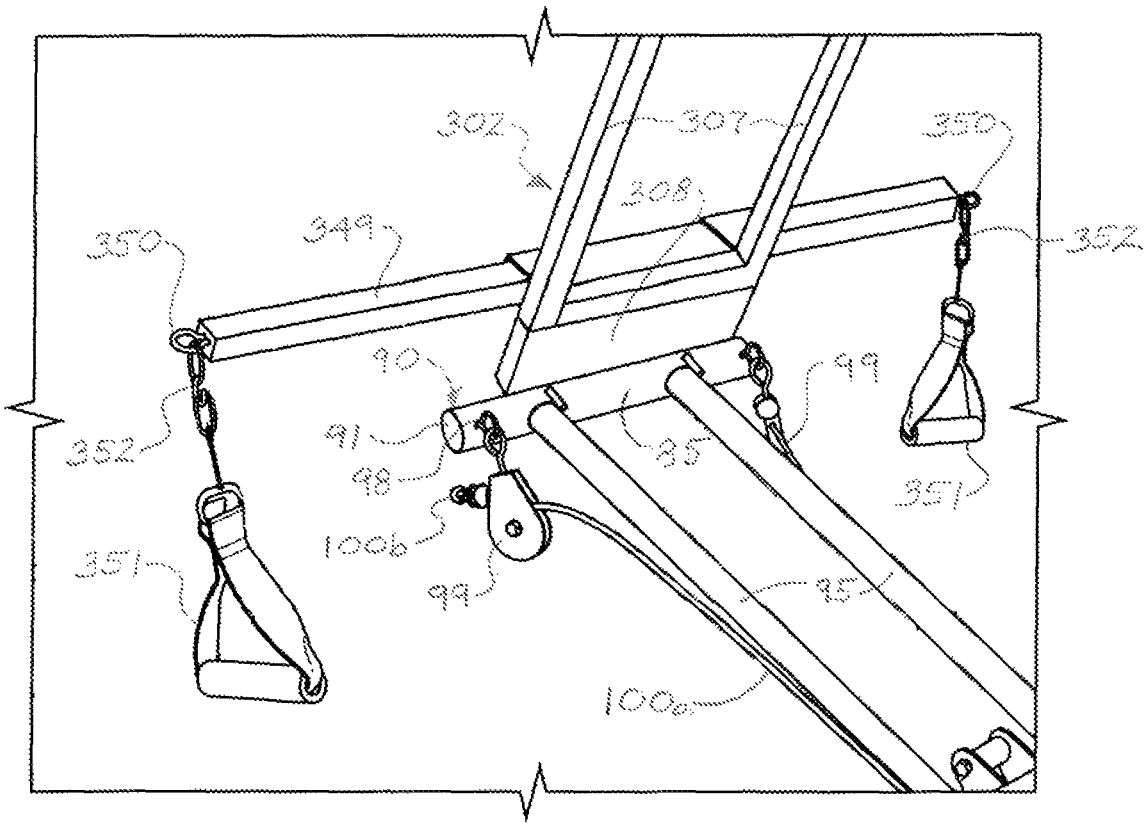
FIG. 20 is a rear perspective view of the assembly frame of the exercise attachment assembly with the pull handle member attached to the assembly frame and a pair of pull handles attached to the pull handle member preparatory to facilitating performance of pulling exercises on the assembly.

Referring next to FIGS. 18-20 of the drawings, yet another illustrative embodiment of the exercise attachment assembly is generally indicated by reference numeral 301. In the exercise attachment assembly 301, elements which are analogous to the respective elements of the exercise attachment assembly 201 that was heretofore described with respect to FIGS. 10-16 are designated by the same respective numerals in the 201-299 series in FIGS. 18-20. The exercise attachment assembly 301 may be configurable in the same manner as was heretofore described with respect to the exercise attachment assembly 201 to perform the same or similar exercises. Accordingly, to the extent applicable, the same description which was heretofore set forth with respect to the exercise attachment assembly 201 is incorporated by reference herein in its entirety with respect to the exercise attachment assembly 301.

The exercise attachment assembly 301 may include the frame support assembly 370 which is deployed on the exercise apparatus 90 heretofore described with respect to FIGS. 1-4. The assembly frame 302 may be deployed in place on the frame support blocks 375 of the frame support assembly 370. Accordingly, the same configurations and exercises which were heretofore described with respect to the exercise attachment assembly 1 in FIGS. 1-4 and the exercise attachment assembly 201 in FIGS. 10-16 may be carried out on the exercise attachment assembly 301.

Figure 21:
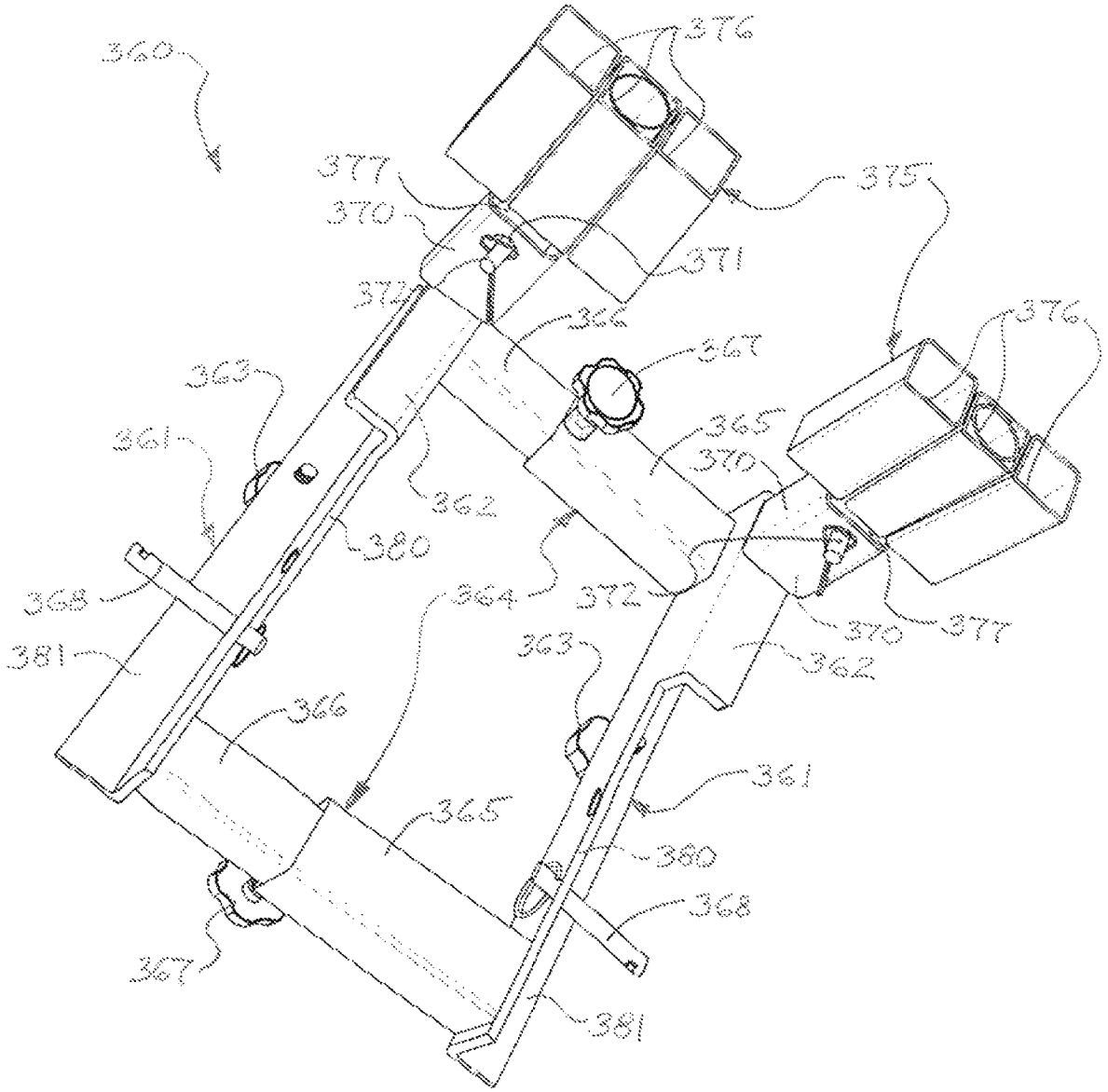
FIG. 21 is a perspective view of a typical block support frame which is configured for inside attachment to the apparatus frame of a slant carriage exercise apparatus as an accessory to support the frame support blocks according to some embodiments of the exercise attachment assemblies.
Figure 22:
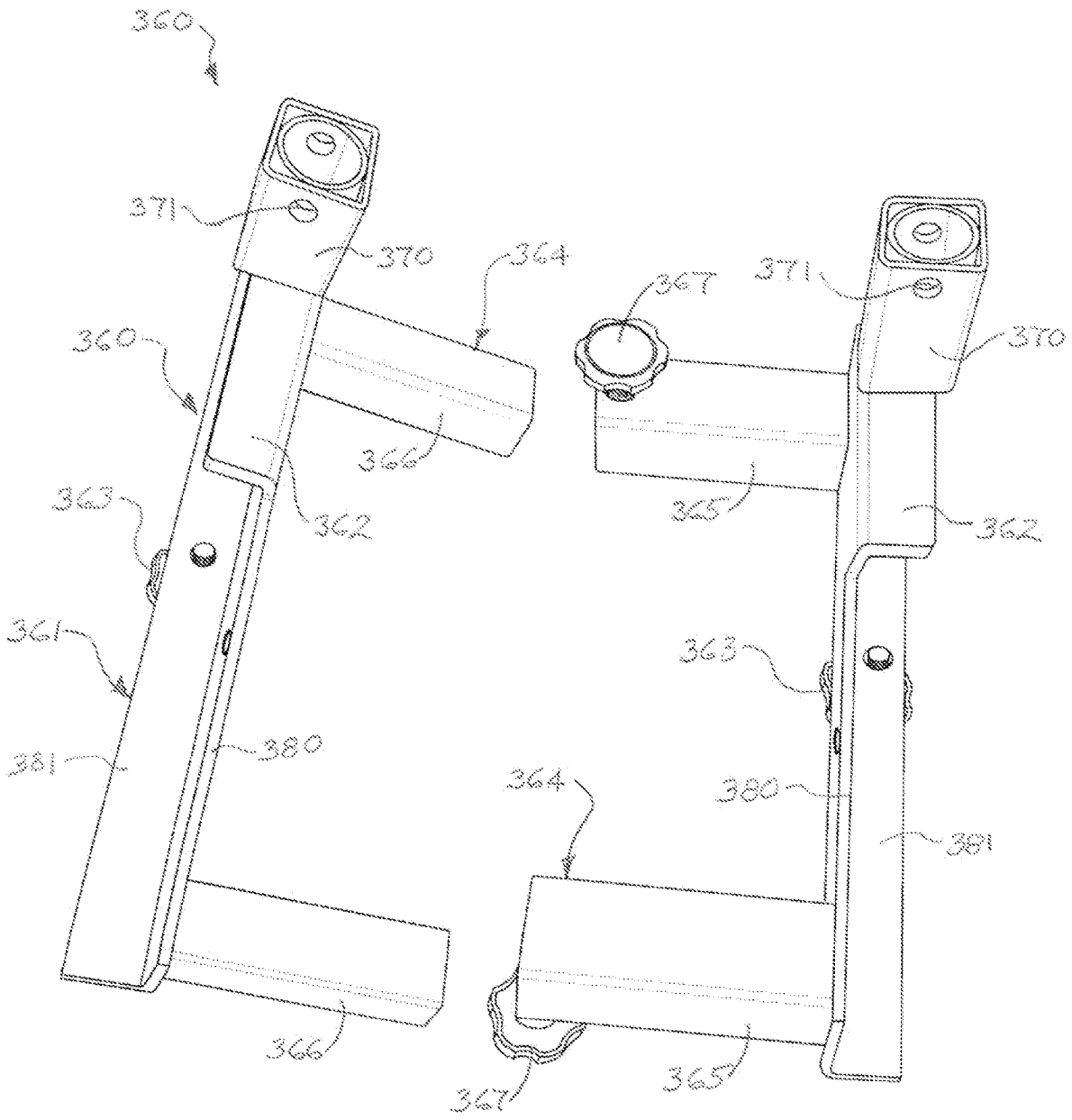
FIG. 22 is an exploded perspective view of the disassembled block support frame illustrated in FIG. 21, with the frame support blocks removed from the respective support block receptacles of the block support frame.
Figure 23:
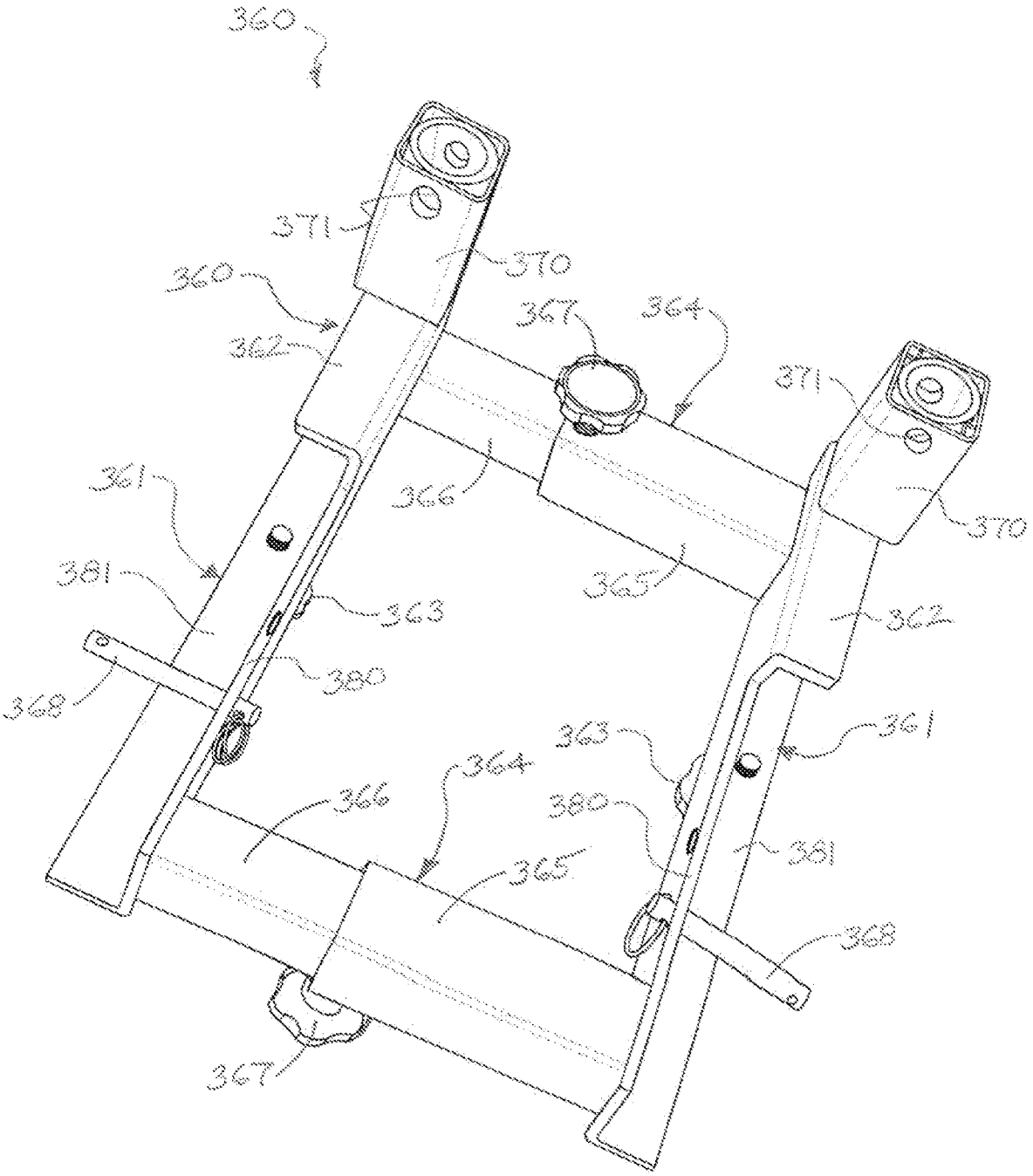
FIG. 23 is a perspective view of the assembled illustrative block support frame with the frame support blocks removed from the respective support block receptacles of the block support frame.

Referring next to FIGS. 21-23 of the drawings, a typical block support frame 360 which is configured for inside attachment to the apparatus frame 95 (FIGS. 10-16) of a slant carriage exercise apparatus 90 as an accessory to support the frame support blocks 375 according to some embodiments of the exercise attachment assemblies is illustrated. The block support frame 360 may include a pair of elongated, parallel, spaced-apart frame arms 361. Each frame arm 361 may be angled in cross-section with a vertical frame segment 380 extending along an inside edge of a horizontal frame segment 381. At least one inner engagement flange 362 may extend outwardly from and along an upper edge of the vertical frame segment 380. Accordingly, each frame arm 381 may be configured to engage each corresponding rail of the apparatus frame 95 of the slant carriage exercise apparatus 90 with the vertical frame segment 380 engaging the inner surface, the horizontal frame segment 381 engaging the bottom surface and the inner engagement flange 362 engaging the top surface of the corresponding rail of the apparatus frame 95. A frame arm knob 363 may be threaded through a corresponding knob opening (not numbered) in the horizontal frame segment 381 of each frame arm 361, The frame arm knob 363 may be threaded through the knob opening and tightened against the corresponding rail of the apparatus frame 95 to secure the block support frame 360 to the apparatus frame 95. In some embodiments, at least one frame pin 368 may be inserted through registering frame pin openings (not illustrated) in each frame arm 361 and in the corresponding rail of the apparatus frame 95 to additionally secure the block support frame 360 on the apparatus frame 95.

At least one frame width adjusting arm 364 may extend between the frame arms 361 of the block support frame 360. Each frame width adjusting arm 364 may be selectively length adjustable. Accordingly, each frame width adjusting arm 364 may include an arm base 365 which extends from one of the frame arms 361. An arm extension 366 may extend from the other of the frame arms 361. The arm extension 366 may be telescopically inserted in the arm base 365. An arm adjusting knob 367 may threadably engage registering knob openings (not numbered) in the arm base 365 and the arm extension 366 to secure the arm extension 366 with respect to the arm base 365. Alternatively, an arm adjusting pin (not illustrated) may be used for the purpose. A plurality of spaced-apart knob openings (not illustrated) may be provided in the arm base 365 and/or the arm extension 366 to secure the frame width adjusting arm 364 at the selected length and the block support frame 360 at the selected width to accommodate the width of the apparatus frame 95.

A support block receptacle 370 may extend upwardly from each frame arm 361 of the block support frame 360, typically at or adjacent to the front end thereof. Each support block receptacle 370 may be attached to the corresponding frame arm 361 via welding, fasteners, brackets and/or other suitable attachment technique known by those skilled in the art. A receptacle pin opening 371, the purpose of which will be hereinafter described, may be provided in each support block receptacle 370.

Each frame support block 375 may include a support block nipple 377. The support block nipple 377 may be suitably sized and configured for insertion into the corresponding support block receptacle 370. The support block nipple 377 of each frame support block 375 may be attached to each corresponding support block receptacle 370 via a receptacle pin 372. The receptacle pin 372 may be extended through the receptacle pin opening 371 in the support block receptacle 370 and through a corresponding registering pin opening (not illustrated) in the support block nipple 377.

At least one support block opening 376 may be provided in the frame support block 375. Each frame support block 375 may be suitably sized and configured to receive an assembly frame 202 such as that which was heretofore described with respect to FIGS. 10-16.

Application of the block support frame 360 may be as was heretofore described with respect to the frame support assembly 270 in FIGS. 11A-16. Accordingly, the block support frame 360 may be attached to the apparatus frame 95 of the slant carrier exercise apparatus 90. The width of the block support frame 360 may be selectively adjusted by sliding the arm extension 366 with respect to the arm base 365 of each frame width adjusting arm 364 and securing the frame width adjusting arm 364 at the selected length typically using the frame adjusting knob 367. The frame support blocks 375 may be attached to the respective support block receptacles 370. The assembly frame 202 may be lowered in place over the frame support blocks 275 and the cable support frame 220 attached to the assembly frame 202 to perform exercises such as those heretofore described with respect to FIGS. 13-17B.

Figure 24:
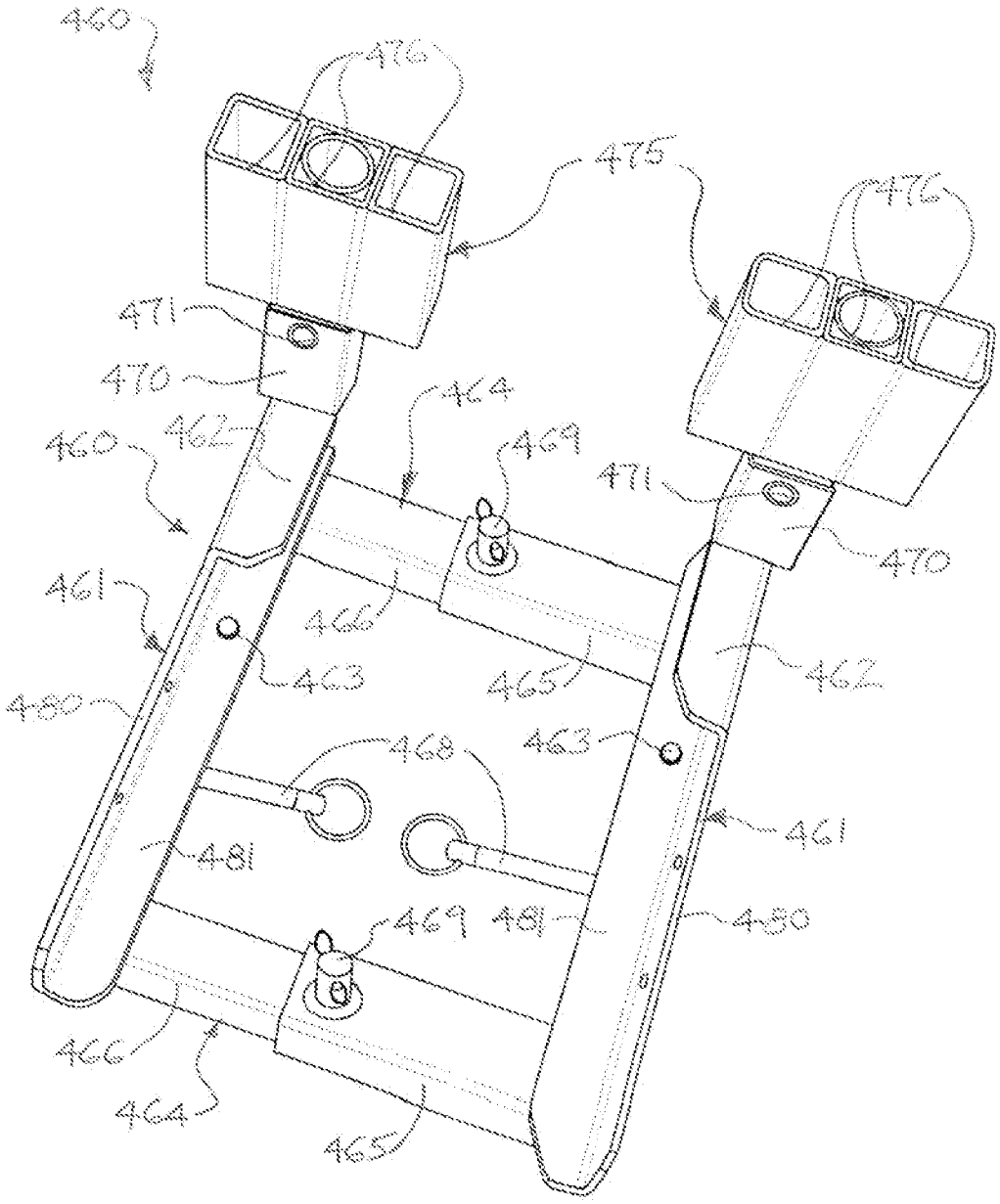
FIG. 24 is a perspective view of a typical block support frame which is configured for outside attachment to the apparatus frame of a slant carriage exercise apparatus as an accessory to support the frame support blocks according to some embodiments of the exercise attachment assemblies.
Figure 25:
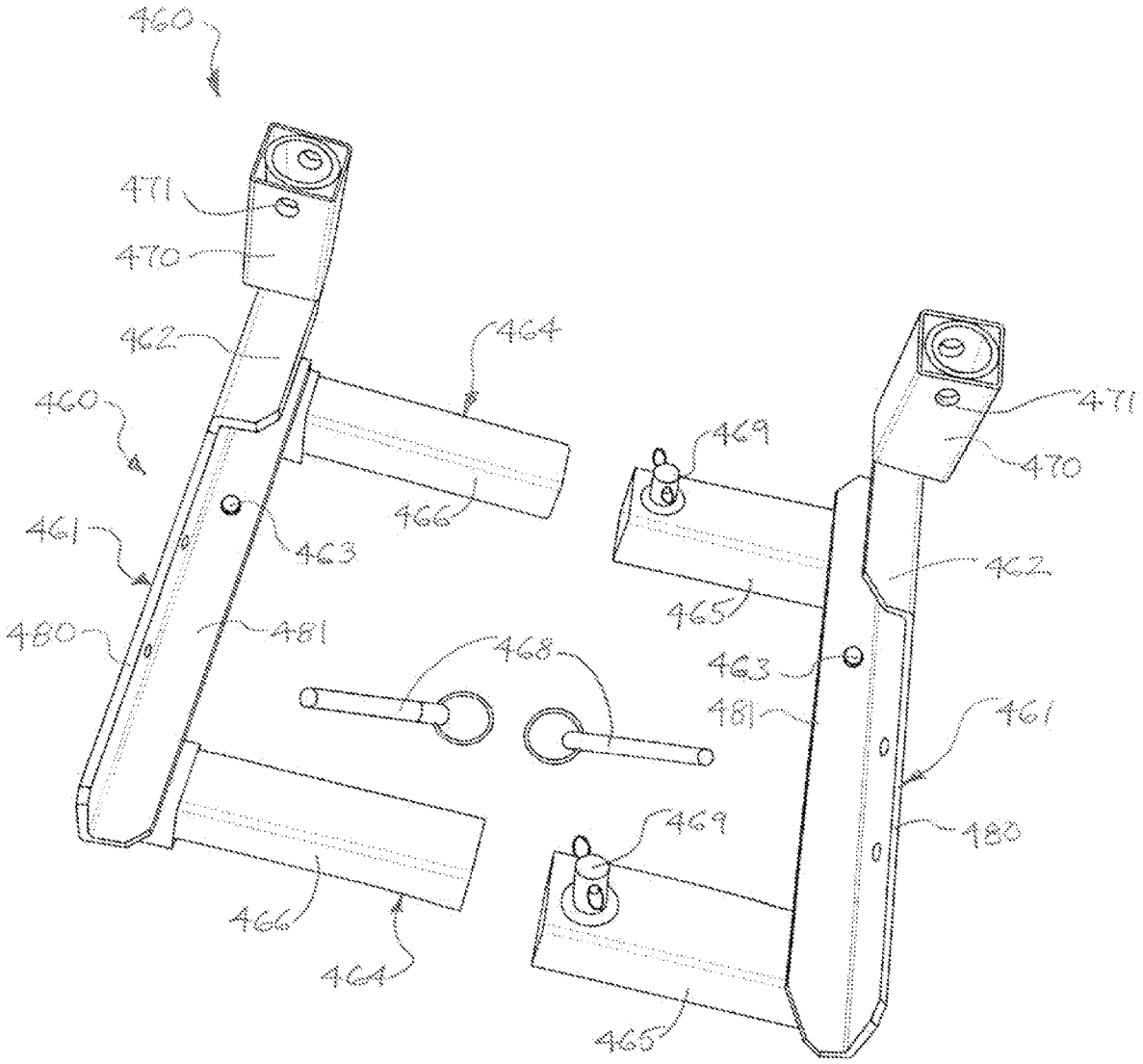
FIG. 25 an exploded perspective view of the disassembled block support frame illustrated in FIG. 24.
Figure 26:
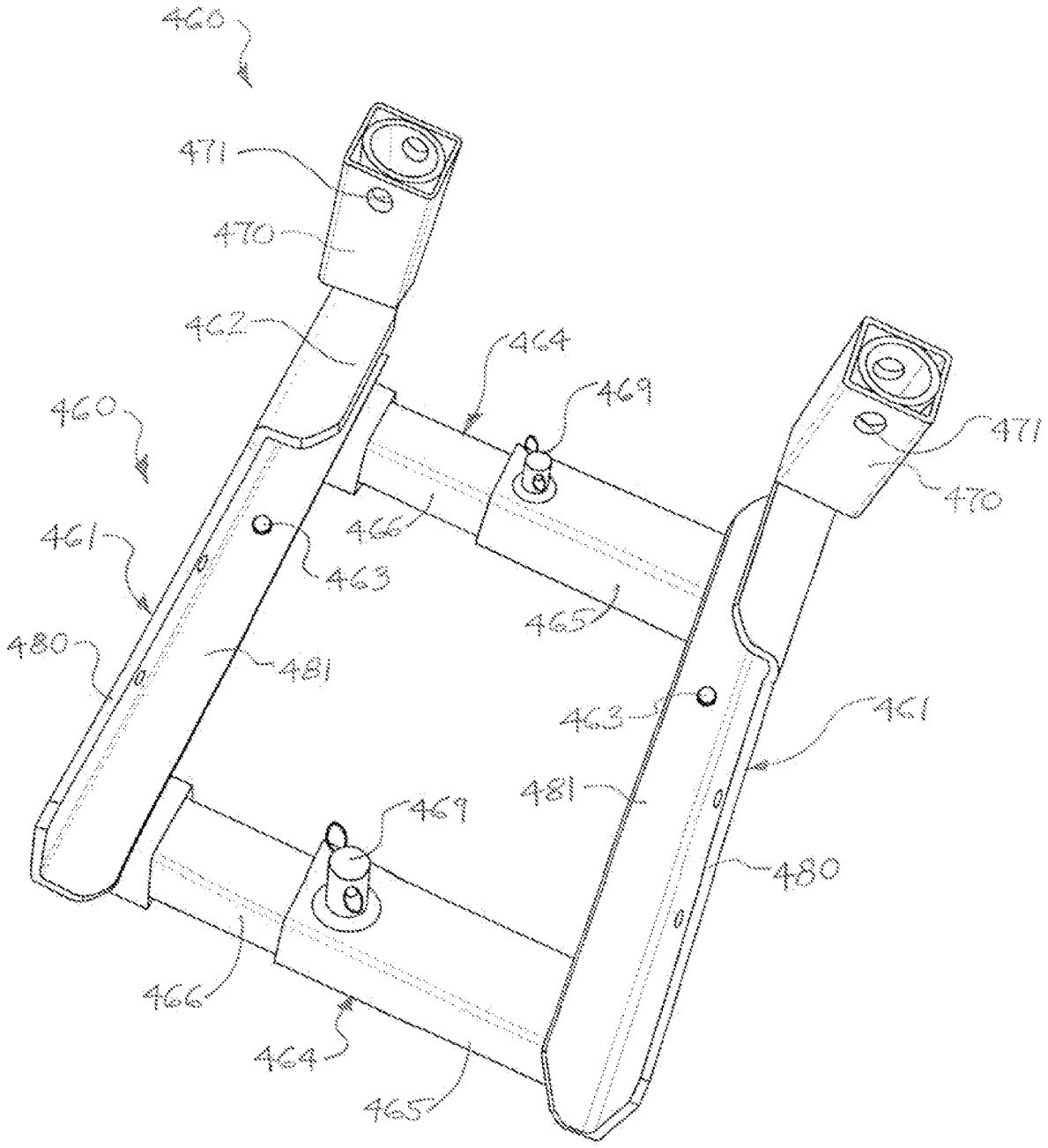
FIG. 26 is a perspective view of the assembled block support frame illustrated in FIG. 24 with the frame support blocks removed from the respective support block receptacles of the block support frame.

Referring next to FIGS. 24-26 of the drawings, an alternative block support frame 460 which is configured for outside attachment to the apparatus frame 95 of a slant carriage exercise apparatus 90 as an accessory to support the frame support blocks 475 according to some embodiments of the exercise attachment assemblies is illustrated. In the block support frame 460, elements which are analogous to the respective elements of the block support frame 360 that was heretofore described with respect to FIGS. 21-23 are designated by the same respective numerals in the 460-481 series in FIGS. 24-26. In the block support frame 460, the vertical frame segment 380 of each frame arm 461 may extend along an outside edge of the horizontal frame segment 381. At least one outer engagement flange 462 may extend inwardly from and along an upper edge of the vertical frame segment 480. Accordingly, each frame arm 461 may be configured to engage each corresponding rail of the apparatus frame 95 of the slant carriage exercise apparatus 90 with the vertical frame segment 480 engaging the outer surface, the horizontal frame segment 481 engaging the bottom surface and the outer engagement flange 462 engaging the top surface of the corresponding rail of the apparatus frame 95. A frame arm knob 463 may be threaded through a corresponding knob opening (not numbered) in the horizontal frame segment 481 of each frame arm 461. The frame arm knob 463 may be threaded through the knob opening and tightened against the corresponding rail of the apparatus frame 95 to secure the block support frame 460 to the apparatus frame 95. In some embodiments, at least one frame pin 468 may be inserted through registering frame pin openings (not illustrated) in each frame arm 461 and in the corresponding rail of the apparatus frame 95 to additionally secure the block support frame 460 on the apparatus frame 95.

An arm adjusting pin 469 may threadably engage registering pin openings (not numbered) in the arm base 465 and the arm extension 466 of each frame with adjusting arm 464 to secure the arm extension 466 with respect to the arm base 465. A plurality of spaced-apart pin openings (not illustrated) may be provided in the arm base 465 and/or the arm extension 466 to secure the frame width adjusting arm 464 at the selected length and the block support frame 460 at the selected width to accommodate the width of the apparatus frame 95.

Application of the block support frame 460 may be as was heretofore described with respect to the block support frame 360 in FIGS. 21-23. Accordingly, the vertical frame segment 480 and the outer engagement flange 462 of each frame arm 461 may engage the inside surface of each rail of the apparatus frame 95 on the slant carriage exercise apparatus 90. The width of the block support frame 460 may be selectively adjusted by sliding the arm extension 466 with respect to the arm base 465 of each frame width adjusting arm 464 and securing the frame width adjusting arm 464 at the selected length typically using the arm adjusting pin 469.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. An exercise attachment assembly for attachment to a slant carriage exercise apparatus having a sloped apparatus frame, a slide seat on the apparatus frame, a pair of main cable pulleys on the apparatus frame and a pair of main cables attached to the slide seat and engaging the pair of main cable pulleys, respectively, the exercise attachment assembly comprising:

an elongated, rectangular assembly frame configured for releasable, vertical attachment to the exercise apparatus, the assembly frame configured to rest on the sloped apparatus frame of the exercise apparatus;

an elongated, horizontal cable support frame releasably supported by the assembly frame, the cable support frame configured to rest on the assembly frame and extending outwardly from opposite sides of the assembly frame;

a pair of outer cable pulleys carried by the cable support frame on the opposite sides, respectively, of the assembly frame;

a pair of outer cables engaging the pair of outer cable pulleys, respectively, the pair of outer cables configured for attachment to the pair of main cables, respectively, of the exercise apparatus;

a pair of outer handles carried by the pair of outer cables, respectively; a pair of inner cable pulleys carried by the cable support frame between the pair of outer cable pulleys, respectively, the inner cable pulleys horizontally spaced apart with respect to the outer cable pulleys and each other along the cable support frame;

a pair of inner cables engaging the pair of inner cable pulleys, respectively, and attachable to the pair of outer cables, respectively, or the pair of main cables, respectively, of the exercise apparatus; and a pair of inner handles carried by the pair of inner cables, respectively.

2. The exercise attachment assembly of claim 1 wherein the assembly frame comprises a base frame portion configured for releasable, vertical attachment to the exercise apparatus and a cable support frame portion adjustably carried by the base frame portion.

3. The exercise attachment assembly of claim 2 wherein the base frame portion of the assembly frame comprises a pair of elongated, parallel, spaced-apart base frame arms configured for attachment to the exercise apparatus; a pair of angled base frame legs extending from the base frame arms, respectively; and a pair of base frame feet carried by the base frame legs, respectively, the base frame feet configured to engage the apparatus frame of the exercise apparatus.

4. The exercise attachment assembly of claim 3 wherein the cable support frame portion of the assembly frame comprises a pair of support frame arms telescopically extendable from the pair of base frame arms, respectively, of the base frame portion and at least one cable support frame mount member carried by the pair of support frame arms.

5. The exercise attachment assembly of claim 4 wherein the apparatus frame of the exercise apparatus comprises a pair of spaced-apart frame collars, and the pair of base frame arms of the base frame portion of the assembly frame are configured to engage the pair of frame collars, respectively.

6. The exercise attachment assembly of claim 1 wherein the cable support frame comprises a pair of elongated main arm segments carried by the assembly frame, and the pair of outer cable pulleys and the pair of inner cable pulleys are carried by the pair of main arm segments.

7. The exercise attachment assembly of claim 6 further comprising a pair of arm bends extending from the pair of main arm segments, respectively, and a pair of terminal arm segments extending from the pair of arm bends, respectively, of the cable support frame, and wherein the pair of outer cable pulleys is carried by the pair of terminal arm segments, respectively, and the pair of inner cable pulleys is carried by the pair of main arm segments, respectively.

8. The exercise attachment assembly of claim 1 further comprising a pair of spaced-apart pull handles carried by the assembly frame.

9. An exercise attachment assembly for attachment to a slant carriage exercise apparatus having a sloped apparatus frame, a slide seat on the apparatus frame, a pair of main cable pulleys on the apparatus frame and a pair of main cables attached to the slide seat and engaging the pair of main cable pulleys, respectively, the exercise attachment assembly comprising:

an elongated, rectangular assembly frame configured for releasable, vertical attachment to the exercise apparatus, the assembly frame configured to rest on the sloped apparatus frame of the exercise apparatus and comprising a pair of elongated, parallel, spaced-apart main frame members configured for attachment to the exercise apparatus;

a pair of spaced-apart pull handle collars on the pair of main frame members, respectively, of the assembly frame;

at least one pull handle member configured for releasable attachment to the pair of pull handle collars, the at least one pull handle member configured to protrude beyond the pair of main frame members of the assembly frame in deployment of the at least one pull handle member in the pair of pull handle collars;

a pair of pull handles attached to the at least one pull handle member on opposite sides of the pair of main frame members of the assembly frame;

an elongated, horizontal cable support frame releasably supported by the assembly frame, the cable support frame configured to rest on the assembly frame and extending outwardly from opposite sides of the assembly frame;

a pair of outer cable pulleys configured for attachment to the cable support frame on the opposite sides, respectively, of the assembly frame;

a pair of outer cables engaging the pair of outer cable pulleys, respectively, the pair of outer cables configured for attachment to the pair of main cables, respectively, of the exercise apparatus;

a pair of outer handles carried by the pair of outer cables, respectively;

a pair of inner cable pulleys configured for attachment to the cable support frame between the pair of outer cable pulleys, respectively, the pair of inner cable pulleys horizontally spaced apart with respect to the pair of outer cable pulleys and each other along the cable support frame;

a pair of inner cables engaging the pair of inner cable pulleys, respectively, and attachable to the pair of outer cables, respectively, or the pair of main cables, respectively, of the exercise apparatus; and a pair of inner handles carried by the pair of inner cables, respectively.

10. The exercise attachment assembly of claim 9 wherein the assembly frame comprises at least one horizontal cable support frame mount member carried by the pair of main frame members, and the cable support frame is carried by the at least one cable support frame mount member.

11. The exercise attachment assembly of claim 10 wherein the cable support frame is selectively length adjustable.

12. The exercise attachment assembly of claim 11 further comprising at least one frame sleeve extending from a first one of the pair of main frame members and at least one frame insertion arm extending from a second one of the pair of main frame members of the assembly frame, the at least one frame sleeve telescopically receiving the at least one frame insertion arm.

13. The exercise attachment assembly of claim 9 further comprising an armrest support frame carried by the at least one pull handle member and a pair of armrests carried by the armrest support frame.

14. The exercise attachment assembly of claim 13 wherein the armrest support frame comprises a pair of elongated, parallel, spaced-apart frame arms; a pair of armrest frame collars carried by the pair of frame arms, respectively, and receiving the at least one pull handle member; and a frame connector connecting the pair of frame arms.

15. An exercise attachment assembly for attachment to a slant carriage exercise apparatus having a sloped apparatus frame, a slide seat on the apparatus frame, a pair of main cable pulleys on the apparatus frame and a pair of main cables attached to the slide seat and engaging the pair of main cable pulleys, respectively, the exercise attachment assembly comprising:

a frame support assembly configured for mounting on the apparatus frame of the exercise apparatus, the frame support assembly comprising:

a pair of spaced-apart support bases configured to extend upwardly from the apparatus frame of the exercise apparatus; and a pair of spaced-apart frame support blocks releasably supported by the pair of support bases, respectively;

an assembly frame carried by the pair of frame support blocks of the frame support assembly, the assembly frame sized and configured to releasably receive the pair of frame support blocks of the frame support assembly;

an elongated, horizontal cable support frame releasably supported by the assembly frame, the cable support frame configured to rest on the assembly frame and extending outwardly from opposite sides of the assembly frame;

a pair of outer cable pulleys carried by the cable support frame on the opposite sides, respectively, of the assembly frame;

a pair of outer cables engaging the pair of outer cable pulleys, respectively, the pair of outer cables configured for attachment to the pair of main cables, respectively, of the exercise apparatus;

a pair of outer handles carried by the pair of outer cables, respectively;

a pair of inner cable pulleys carried by the cable support frame between the pair of outer cable pulleys, respectively, the pair of inner cable pulleys horizontally spaced apart with respect to the pair of outer cable pulleys and each other along the cable support frame;

a pair of inner cables engaging the pair of inner cable pulleys, respectively, and attachable to the pair of outer cables, respectively, or the pair of main cables, respectively, of the exercise apparatus; and a pair of inner handles carried by the pair of inner cables, respectively.

16. The exercise attachment assembly of claim 15 further comprising a pair of spaced-apart pull handle collars carried by the assembly frame, at least one pull handle member extending through the pair of pull handle collars and a pair of spaced-apart pull handles attached to the at least one pull handle member, the at least one pull handle member protruding beyond opposite sides of the assembly frame in deployment of the at least one pull handle member in the pair of pull handle collars.

17. The exercise attachment assembly of claim 16 further comprising an armrest support frame carried by the at least one pull handle member and a pair of armrests carried by the armrest support frame, the armrest support frame comprising a pair of elongated, parallel, spaced-apart frame arms; a pair of armrest frame collars carried by the pair of frame arms, respectively, and receiving the at least one pull handle member on the opposite sides of the assembly frame; and a frame connector connecting the pair of frame arms across the apparatus frame of the exercise apparatus.

18. The exercise attachment assembly of claim 15 wherein the assembly frame comprises a pair of elongated, parallel, spaced-apart vertical frame members and a bottom frame member and a top frame member extending between the pair of vertical frame members.

19. The exercise attachment assembly of claim 15 further comprising at least one support block opening in each of the pair of frame support blocks and wherein the assembly frame engages the at least one support block opening.

* * * * *